US011360419B2

(12) United States Patent
Kimura

(10) Patent No.: US 11,360,419 B2
(45) Date of Patent: Jun. 14, 2022

(54) IMAGE FORMING APPARATUS, IMAGE FORMING METHOD AND IMAGE FORMING PROGRAM CAPABLE OF IMPROVING CLEANING PERFORMANCE BY A CLEANING BLADE

(71) Applicant: Konica Minolta, Inc., Tokyo (JP)

(72) Inventor: Masato Kimura, Toyoake (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/353,759

(22) Filed: Jun. 21, 2021

(65) Prior Publication Data

US 2022/0011701 A1 Jan. 13, 2022

(30) Foreign Application Priority Data

Jul. 13, 2020 (JP) ..... JP2020-120136

(51) Int. Cl.
*G03G 15/16* (2006.01)
*G03G 15/00* (2006.01)
*G03G 21/00* (2006.01)

(52) U.S. Cl.
CPC ..... *G03G 15/50* (2013.01); *G03G 15/161* (2013.01); *G03G 21/0011* (2013.01)

(58) Field of Classification Search
CPC .. G03G 15/161; G03G 15/50; G03G 15/5054; G03G 15/553
USPC ..... 399/24, 31, 71, 101
See application file for complete search history.

(56) References Cited

U.S. PATENT DOCUMENTS 7,738,807 B2 * 6/2010 Inada et al. ..... G03G 21/0011 399/71
7,894,759 B2 * 2/2011 Yagi ..... G03G 15/161 399/101
9,164,465 B2 * 10/2015 Mori et al. ..... G03G 21/0011
2011/0268468 A1 * 11/2011 Adachi et al. ..... G03G 15/161 399/101

FOREIGN PATENT DOCUMENTS

JP 2010-026380 A 2/2010

* cited by examiner

*Primary Examiner* — William J Royer
(74) *Attorney, Agent, or Firm* — Lucas & Mercanti, LLP

(57) ABSTRACT

An image forming apparatus includes: an image carrier that carries a toner image including toner; a driver that rotates the image carrier; a toner remover that comes in contact with the image carrier and removes toner remaining on the image carrier while the image carrier is rotated in a forward direction by the driver; and a hardware processor that evaluates a degree of deterioration of the image carrier or the toner remover, determines a number of times of execution of removal operation in which the image carrier is rotated in a reverse direction and then rotated in the forward direction, on the basis of the degree of deterioration, and controls the driver to cause the removal operation to be executed the number of times of execution.

13 Claims, 13 Drawing Sheets

IMAGE FORMING APPARATUS, IMAGE FORMING METHOD AND IMAGE FORMING PROGRAM CAPABLE OF IMPROVING CLEANING PERFORMANCE BY A CLEANING BLADE

The entire disclosure of Japanese patent Application No. 2020-120136, filed on Jul. 13, 2020, is incorporated herein by reference in its entirety.

BACKGROUND

Technological Field

The present invention relates to an image forming apparatus, an image funning method and an image forming program, and in particular relates to an image forming apparatus including a cleaning blade provided to be in contact with an intermediate transfer belt, and an image forming method and an image forming program executed by the image forming apparatus.

Description of the Related Art

In an intermediate transfer method image forming apparatus, a latent image on a photoreceptor drum is developed, whereby a toner image is formed. The toner image formed on the photoreceptor drum is transferred to an intermediate transfer belt. The toner image transferred to the intermediate transfer belt is further transferred to a recording medium such as a sheet, whereby an image is formed on the recording medium. The toner image remaining on the intermediate transfer belt is removed by a cleaning blade provided to be in contact with the intermediate transfer belt. Here, paper dust may be bitten between the intermediate transfer belt and the cleaning blade, whereby cleaning failure may occur. The bitten paper dust can be removed by rotating the intermediate transfer belt in a reverse direction. Furthermore, as an amount of reverse rotation is increased, a larger amount of paper dust is removed.

For example, in JP 2010-26380 A, an image forming apparatus is described that includes at least a latent image carrier and a developing unit that develops a latent image on the latent image carrier to form a toner image, and includes: an image formation unit detachable to an apparatus main body; an endless belt that comes in contact with the image formation unit that conveys the toner image or a recording sheet; a cleaning unit that removes residual toner on the endless belt; and a drive unit enabled to rotationally drive the endless belt in both forward and reverse directions, in which first reverse rotation in which the endless belt is rotated in an opposite direction at regular intervals, and second reverse rotation in which the endless belt is rotated in an opposite direction after detection of a life end of the image formation unit are performed, and an amount of reverse rotation of the second reverse rotation is greater than an amount of reverse rotation of the first reverse rotation.

According to the image forming apparatus described in JP 2010-26380 A, when the image formation unit reaches the life end, the amount of reverse rotation of the endless belt is increased, whereby a foreign matter of the cleaning unit can be removed more effectively than that before. However, before the image formation unit reaches the life end, cleaning performance by the cleaning unit is about the same as that by the conventional one. For that reason, it is desired to improve the cleaning performance by the cleaning unit.

SUMMARY

The present invention has been made to solve the problem described above, and one of objects of the present invention is to provide an image forming apparatus capable of improving the cleaning performance by a cleaning blade.

Another object of the present invention is to provide an image forming method capable of improving the cleaning performance by a cleaning blade.

Yet another object of the present invention is to provide an image forming program capable of improving the cleaning performance of a cleaning blade.

To achieve at least one of the above mentioned objects, according to an aspect of the present invention, an image forming apparatus reflecting one aspect of the present invention comprises: an image carrier that carries a toner image including toner; a driver that rotates the image carrier; a toner remover that comes in contact with the image carrier and removes toner remaining on the image carrier while the image carrier is rotated in a forward direction by the driver; and a hardware processor that evaluates a degree of deterioration of the image carrier or the toner remover, determines a number of times of execution of removal operation in which the image carrier is rotated in a reverse direction and then rotated in the forward direction, on the basis of the degree of deterioration, and controls the driver to cause the removal operation to be executed the number of times of execution.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
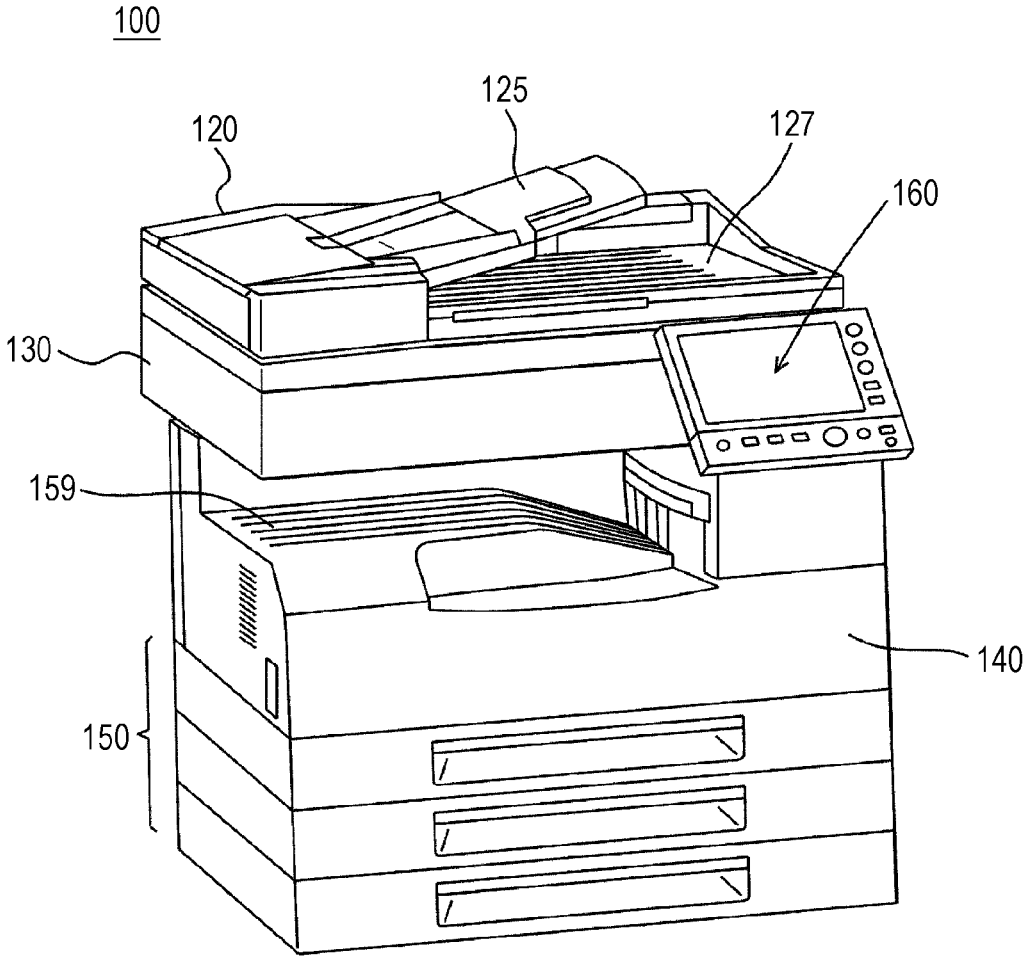
FIG. 1 is a perspective view illustrating an appearance of an MFP in an embodiment of the present invention.

Hereinafter, one or more embodiments of the present invention will be described with reference to the drawings. However, the scope of the invention is not limited to the disclosed embodiments. In the following description, the same components are denoted by the same reference numerals. The names and functions thereof are also the same. Thus, detailed description thereof will not be repeated. Furthermore, in the following description, an MFP will be described as an example of an image forming apparatus. Moreover, in a Multi Function Peripheral (MFP) described below, a recording medium on which an image is to be formed includes a sheet such as a plain sheet, a high quality sheet, a recycled sheet, or a photographic sheet, and an Over Head Projector (OHP) film.

Figure 2:
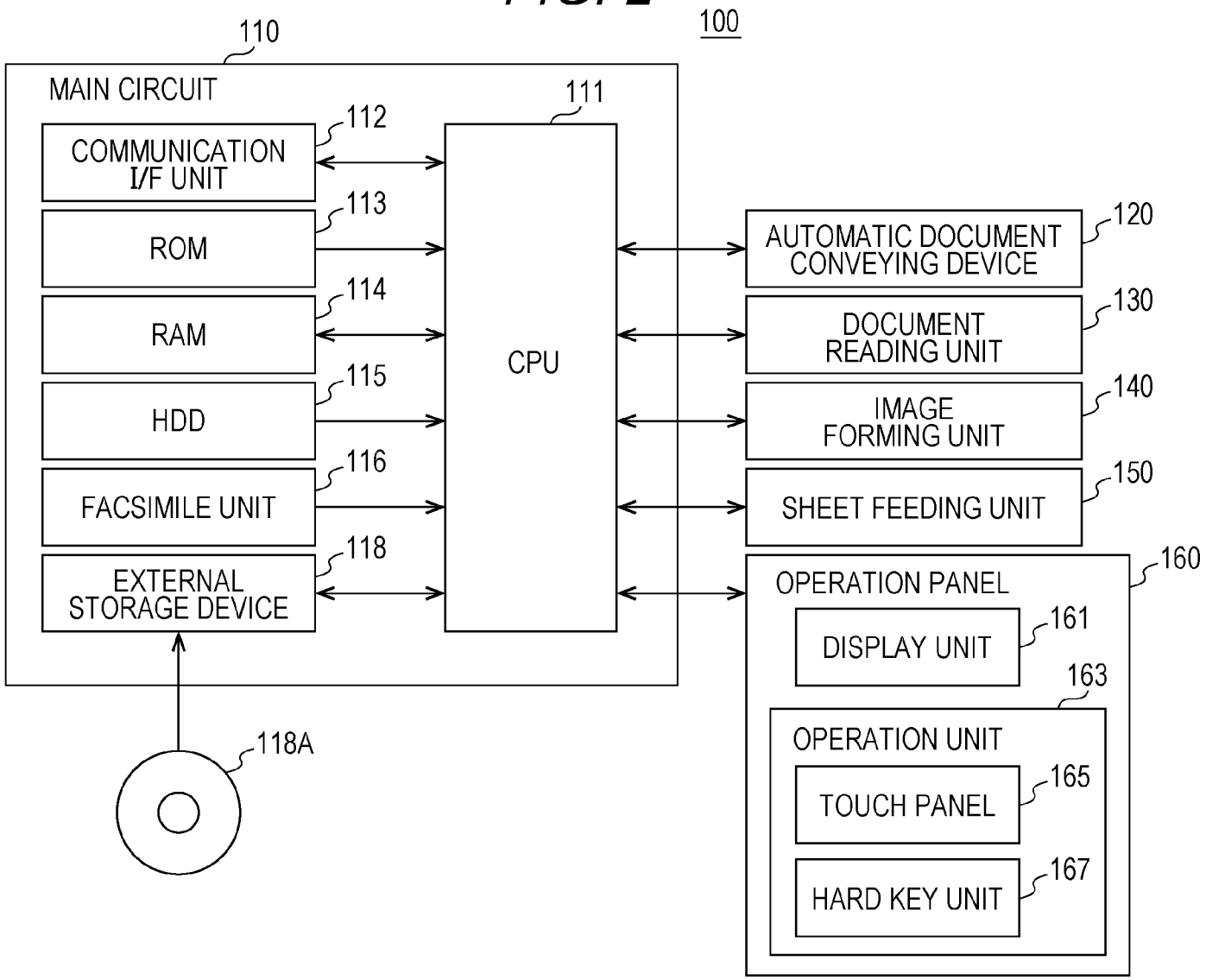
FIG. 2 is a block diagram illustrating an outline of a hardware configuration of the MFP.

FIG. 1 is a perspective view illustrating an appearance of the MFP in the present embodiment. FIG. 2 is a block diagram illustrating an outline of a hardware configuration of the MFP. With reference to FIGS. 1 and 2, an MFP 100 is an example of the image forming apparatus, and includes: a main circuit 110; a document reading unit 130 for reading a document; an automatic document conveying device 120 for conveying the document to the document reading unit 130; an image forming unit 140 for forming an image on a recording medium on the basis of image data; a sheet feeding unit 150 for supplying a recording medium to the image forming unit 140; and an operation panel 160 as a user interface.

The automatic document conveying device 120 automatically conveys a plurality of sheets set on a document tray 125 one by one to a document reading position of the document reading unit 130, and ejects a document from which an image formed on the document by the document reading unit 130 is read onto a document ejection tray 127. The automatic document conveying device 120 includes a document detection sensor that detects a document placed on the document tray 125.

The document reading unit 130 includes a rectangular reading surface for reading a document. The reading surface is formed of, for example, platen glass. The automatic document conveying device 120 is connected to a main body of the MFP 100 rotatably about a shaft parallel to one side of the reading surface, and can be opened and closed. The document reading unit 130 is arranged below the automatic document conveying device 120, and the reading surface of the document reading unit 130 is exposed in an open state in which the automatic document conveying device 120 is rotated and opened. A user can therefore place the document on the reading surface of the document reading unit 130. The automatic document conveying device 120 can change states between the open state in which the reading surface of the document reading unit 130 is exposed and a closed state in which the reading surface is covered. The automatic document conveying device 120 includes a state detection sensor that detects the open state of the automatic document conveying device 120.

The document reading unit 130 includes a light source that emits light and a photoelectric conversion element that receives light, and scans an image formed on a document placed on the reading surface. When a document is placed in a reading area, the light emitted from the light source is reflected by the document, and the reflected light forms an image on the photoelectric conversion element. Upon receiving the light reflected by the document, the photoelectric conversion element generates image data obtained by converting the received light into an electric signal. The document reading unit 130 outputs the image data to a Central Processing Unit (CPU) Ill included in the main circuit 110.

The sheet feeding unit 150 takes out a recording medium stored in any of a plurality of sheet feeding trays or a manual feed tray, and conveys the recording medium to the image forming unit 140.

The image forming unit 140 is controlled by the CPU 111, and forms an image on a recording medium conveyed by the sheet feeding unit 150 by a well-known electrophotographic method. In the present embodiment, the image forming unit 140 forms an image of image data input from the CPU 111 on a recording medium conveyed by the sheet feeding unit 150. The recording medium on which the image is formed is ejected to a sheet ejection tray 159. The image data output by the CPU 111 to the image forming unit 140 includes image data such as print data received from the outside in addition to image data input from the document reading unit 130.

The main circuit 110 includes the CPU 111 that controls the entire MFP 100, a communication interface (I/F) unit 112, a Read Only Memory (ROM) 113, a Random Access Memory (RAM) 114, a hard disk drive (HDD) 115 as a large-capacity storage device, a facsimile unit 116, and an external storage device 118. The CPU 111 is connected to the automatic document conveying device 120, the document reading unit 130, the image forming unit 140, the sheet feeding unit 150, and the operation panel 160, and controls the entire MFP 100.

The ROM 113 stores a program executed by the CPU 111 or data necessary for executing the program. The RAM 114 is used as a work area when the CPU 111 executes the program. Furthermore, the RAM 114 temporarily stores image data continuously sent from the document reading unit 130.

The operation panel 160 is provided on the upper part of the MFP 100. The operation panel 160 includes a display unit 161 and an operation unit 163. The display unit 161 is, for example, a liquid crystal display device (LCD), and displays an instruction menu for the user, information regarding acquired image data, and the like. Note that, instead of the LCD, for example, an organic electroluminescence (EL) display can be used as a device that displays an image.

The operation unit 163 includes a touch panel 165 and a hard key unit 167. The touch panel 165 is of a capacitance type. The touch panel 165 is not limited to the capacitance type, and other types can be used such as a resistive film type, a surface acoustic wave type, an infrared type, or an electromagnetic induction type.

The touch panel 165 is provided with its detection surface superimposed on the display unit 161 on the upper surface or the lower surface of the display unit 161. Here, the size of the detection surface of the touch panel 165 and the size of a display surface of the display unit 161 are the same as each other. For this reason, a coordinate system of the display surface and a coordinate system of the detection surface are the same as each other. The touch panel 165 detects, by the detection surface, a position on the display surface of the display unit 161 indicated by the user, and outputs coordinates of the detected position to the CPU 111. Since the coordinate system of the display surface and the coordinate system of the detection surface are the same as each other, the coordinates output by the touch panel 165 can be replaced with coordinates of the display surface.

The hard key unit 167 includes a plurality of hard keys. The hard key is, for example, a contact switch. The touch panel 165 detects a position indicated by the user on the display surface of the display unit 161. When the user operates the MFP 100, the user's posture is often upright, so that the display surface of the display unit 161, an operation surface of the touch panel 165, and the hard key unit 167 are arranged facing upward. This is for enabling the user to easily visually recognize the display surface of the display unit 161 and the user to easily indicate the operation unit 163 with a finger.

The communication DT unit 112 is an interface for connecting the 100 to a network. The communication unit 112 communicates with another computer connected to the network by a communication protocol such as Transmission Control Protocol (TCP) or User Datagram Protocol (UDP). Note that, the network to which the communication I/F unit 112 is connected is a local area network (LAN), and connection form may be wired or wireless. Furthermore, the network is not limited to the LAN, and may be a wide area network (WAN), a public switched telephone network (PSTN), the Internet, or the like.

The facsimile unit 116 is connected to the public switched telephone network (PSTN) and transmits facsimile data to or receives facsimile data from the PSTN. The facsimile unit 116 stores the received facsimile data in the HDD 115, and converts the data into print data that can be printed by the image forming unit 140, to output the data to the image forming unit 140. As a result, the image forming unit 140 forms an image of the facsimile data received by the facsimile unit 116 on the sheet. Furthermore, the facsimile unit 116 converts data stored in the HDD 115 into facsimile data and transmits the data to a facsimile device connected to the PSTN.

The external storage device 118 is controlled by the CPU 111, and a Compact Disk Read Only Memory (CD-ROM) 118A or a semiconductor memory is mounted thereto. In the present embodiment, an example will be described in which the CPU 111 executes a program stored in the ROM 113; however, the CPU 111 may control the external storage device 118, and read a program to be executed by the CPU 111 from the CD-ROM 118A, store the read program in the RAM 114, and execute the program.

Note that, a recording medium that stores the program to be executed by the CPU 111 is not limited to the CD-ROM 118A, but may be a medium such as a flexible disk, a cassette tape, an optical disk (Magnetic Optical Disc (MO)/Mini Disc (MD)/Digital Versatile Disc (DVD)), an IC card, an optical card, or a semiconductor memory such as a mask ROM or an Erasable Programmable ROM (EPROM). Moreover, the CPU 111 may download the program from the computer connected to the network and store the program in the HDD 115, or the computer connected to the network may write the program to the HDD 115, and the program stored in the HDD 115 may be loaded into the RAM 114, and the program may be executed by the CPU 111. The program referred to here includes not only a program that can be directly executed by the CPU 111, but also a source program, a compressed program, an encrypted program, and the like.

Figure 3:
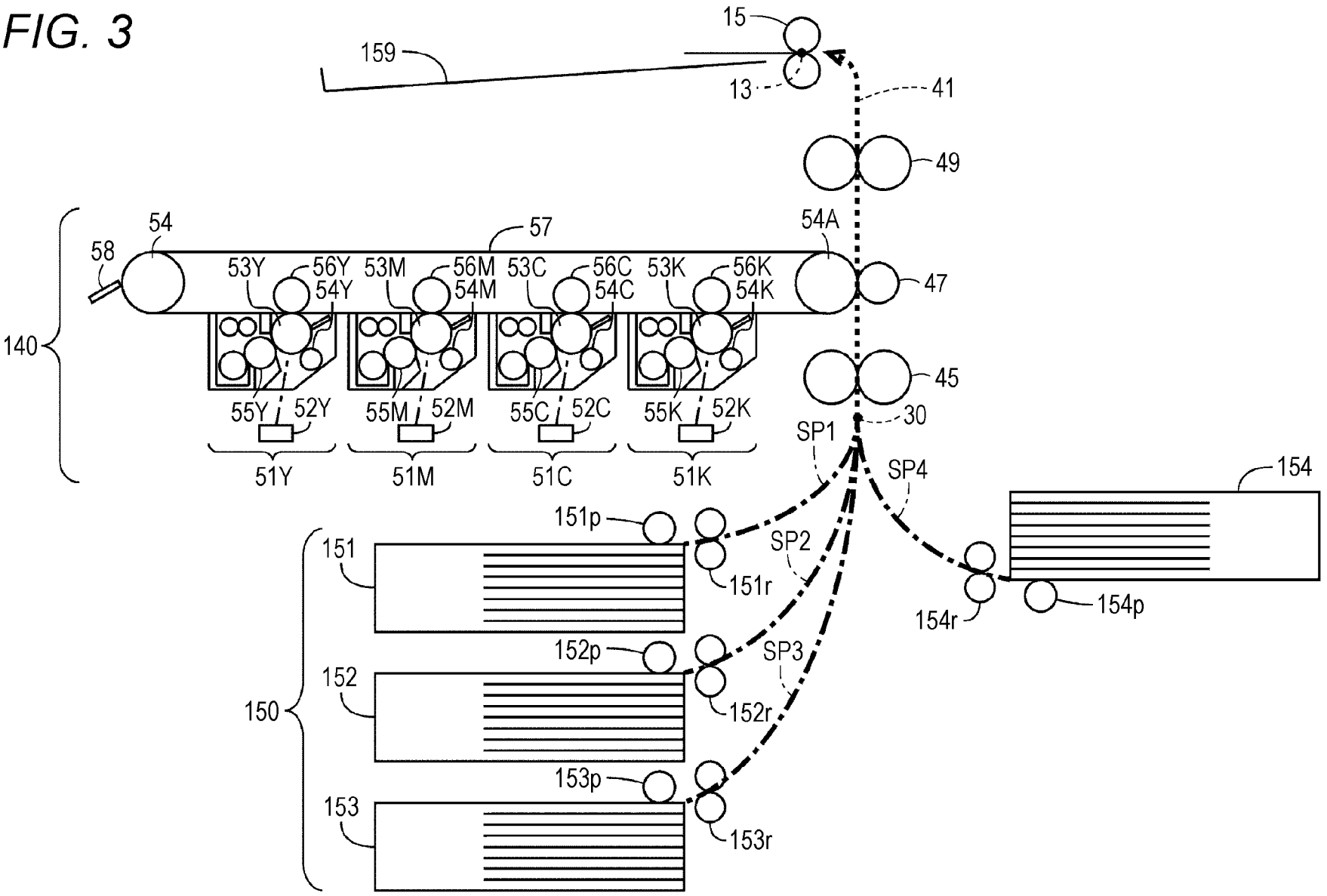
FIG. 3 is a schematic side view illustrating an internal configuration of a part of an image forming unit and a sheet feeding unit.

FIG. 3 is a schematic side view illustrating an internal configuration of a part of the image forming unit 140 and the sheet feeding unit 150. With reference to FIG. 3, inside the MFP 100, a main conveying path 41 indicated by a thick dotted arrow is formed to extend basically in the vertical direction. The main conveying path 41 is a path for guiding a sheet conveyed from the sheet feeding unit 150 to the sheet ejection tray 159 through the image forming unit 140. In the main conveying path 41 of this example, a lower end 30 on an opposite side from an upper end 13 located above the image forming unit 140 constitutes a loading port that receives a sheet from the sheet feeding unit 150. Furthermore, the upper end 13 of the main conveying path 41 constitutes an ejection port that ejects a sheet after image formation to Lite sheet ejection tray 159. A sheet ejection roller 15 is provided at the upper end 13 of the main conveying path 41.

The sheet feeding unit 150 includes three sheet feeding trays 151, 152, and 153 and a manual feed tray 154. The three sheet feeding trays 151, 152, and 153 are stacked to be arranged from top to bottom in this order. The manual feed tray 154 is provided on a side wall of the MFP 100 and is located below the image forming unit 140. As illustrated by a thick one-dot chain line in FIG. 3, the sheet feeding trays 151, 152, and 153 and the manual feed tray 154 are connected to the lower end 30 of the main conveying path 41 through sub-conveys ng paths SP1, SP2, SP3, and SP4, respectively.

A pickup roller 151*p* and a sheet feeding roller 151*r* are provided corresponding to the sheet feeding tray 151. The sheet feeding roller 151*r* is provided in the sub-conveying path SP1. A pickup roller 152*p* and a sheet feeding roller 152*r* are provided corresponding to the sheet feeding tray 152. The sheet feeding roller 152*r* is provided in the sub-conveying path SP2. A pickup roller 153*p* and a sheet feeding roller 153*r* are provided corresponding to the sheet feeding tray 153. The sheet feeding roller 153*r* is provided in the sub-conveying path SP3. A pickup roller 154*p* and a sheet feeding roller 154*r* are provided corresponding to the manual feed tray 154. The sheet feeding roller 154*r* is provided in the sub-conveying path SP4. Since operations of taking out the recording media from the respective sheet feeding trays 151, 152, 153 and the manual feed tray 154, and conveying the recording media are the same as each other, here, the sheet feeding tray 151 will be described as an example.

In the sheet feeding tray 151, one or more recording media are stored in a stacked state. The sheet feeding tray 151 includes a lift-up mechanism that pushes up one or more recording media stored therein. The pickup roller 151*p* is urged by an elastic member such as a spring to abut, from above, the uppermost recording medium of one or more recording media stored in the sheet feeding tray 151. The pickup roller 151*p* presses the recording medium from above. The pickup roller 151*p* rotates, whereby the uppermost recording medium is sent out to the sub-conveying path SP1 due to frictional force with the recording medium.

The recording medium sent out to the sub-conveying path SP1 is supplied to the main conveying path 41 by the sheet feeding roller 151*r*.

In the MFP 100, during image formation, a tray storing the recording medium to be subjected to image formation is selected as a target tray from the three sheet feeding trays 151, 152, 153 and the manual feed tray 154. A pickup roller and a sheet, feeding roller operate that correspond to the tray selected as the target tray among the three sheet feeding trays 151, 152, and 153 and the manual feed tray 154, whereby the recording medium is supplied to the main conveying path 41 through any of the sub-conveying paths SP1, SP2, SP3, and SP4 from the tray selected as the target tray.

The image forming unit 140 forms an image by an intermediate transfer method. The image forming unit 140 includes image formation units 51Y, 51M, 51C, and 51K of respective colors of yellow, magenta, cyan, and black. At least one of the image formation units 51Y, 51M, 51C, and 51K are driven, whereby an image is formed on the recording medium. All of the image formation units 51Y, 51M, 51C, and 51K are driven, whereby a full-color image is formed. Print data of yellow, magenta, cyan, and black are input to the image formation units 51Y, 51M, 51C, and 51K, respectively. Since the image formation units 51Y, 51M, 51C, and 51K differ only in colors of toners handled by the units, here, the image formation unit 51Y for forming a yellow image will be described.

The image formation unit 51Y includes an exposure head 52Y into which yellow print data is input, a photoreceptor drum 53Y, a charging roller 54Y, a developing roller 55Y, and a primary transfer roller 56Y. The exposure head 52Y emits laser light depending on the received print data (electric signal). One-dimensional scanning by the emitted laser light is performed by the polygon mirror included in the exposure head 52Y, to expose the photoreceptor drum 53Y. A one-dimensional scanning direction of the photoreceptor drum 53Y is the main scanning direction. The charging roller 54Y is an elastic body and is arranged to be in pressure contact with the photoreceptor drum 53Y. The photoreceptor drum 53Y is charged by the charging roller 54Y and then irradiated with the laser light emitted by the exposure head 52Y. As a result, an electrostatic latent image is formed on the photoreceptor drum 53Y. Subsequently, toner is placed on the electrostatic latent image by the developing roller 55Y, and a toner image is formed. The toner image formed on the photoreceptor drum 53Y is transferred onto an intermediate transfer belt 57 (image carrier) by the primary transfer roller 56Y.

Similarly, the image formation unit 51M includes an exposure head 52M into which magenta print data is input, a photoreceptor drum 53M, a charging roller 54M, a developing roller 55M, and a primly transfer roller 56M. The image formation unit 51C includes an exposure head 52C into which cyan print data is input, a photoreceptor drum 53C, a charging roller 54C, a developing roller 55C, and a primary transfer roller 56C. The image formation unit 51K includes an exposure head 52K into which black print data is input, a photoreceptor drum 53K, a charting roller 54K, a developing roller 55K, and a primary transfer roller 56K.

The intermediate transfer belt 57 is suspended by a drive roller 54 and a roller 54A not to be loosened. When the drive roller 54 rotates counterclockwise in the figure, the intermediate transfer belt 57 rotates counterclockwise in the figure at a predetermined speed. With rotation of the intermediate transfer belt 57, the roller 54A rotates counterclockwise.

As a result, the image formation units 51Y, 51M, 51C, and 51K sequentially transfer toner images onto the intermediate transfer belt 57. A timing at which each of the image formation units 51Y, 51M, 51C, and 51K transfers the toner image onto the intermediate transfer belt 57 is adjusted by detecting a reference mark attached to the intermediate transfer belt 57. As a result, yellow, magenta, cyan, and black toner images are superimposed on the intermediate transfer belt 57.

In the main conveying path 41 described above, a timing roller 45, a secondary transfer roller 47, and a fixing roller 49 are arranged at intervals in this order from the lower end 30 to the upper end 13. The secondary transfer roller 47 is formed of an elastic body such as foam rubber, and is in pressure contact with the roller 54A with the intermediate transfer belt 57 interposed therebetween. The recording, medium supplied from the sheet feeding unit 150 to the conveying path 41 is sent to the timing roller 45.

The timing roller 45 adjusts a conveying state of the recording medium in the main conveying path 41 so that the recording medium reaches between the roller 54A and the secondary transfer roller 47 at a timing when the toner image formed on the intermediate transfer belt 57 reaches between the roller 54A and the secondary transfer roller 47. The recording medium conveyed by the timing roller 45 is pressed against the intermediate transfer belt 57 by the secondary transfer roller 47, and the secondary transfer roller 47 is charged, whereby a yellow, magenta, cyan, or black toner image formed to be superimposed on the intermediate transfer belt 57 is transferred. A voltage applied to the secondary transfer roller 47 is controlled by the CPU 111 so that an amount of charge of the secondary transfer roller 47 is a value suitable for a basis weight of the recording medium.

The recording medium on which the toner image is transferred is conveyed to the fixing roller 49 and heated by the fixing roller 49. As a result, the toner is melted and fixed on the recording medium. Thereafter, the recording medium after image formation is ejected from the upper end 13 of the main conveying path 41 onto the sheet ejection tray 159 by the sheet ejection roller 15. A temperature of the fixing roller 49 is controlled by the CPU 111 to have a value suitable for the basis weight of the recording medium.

Figure 4:
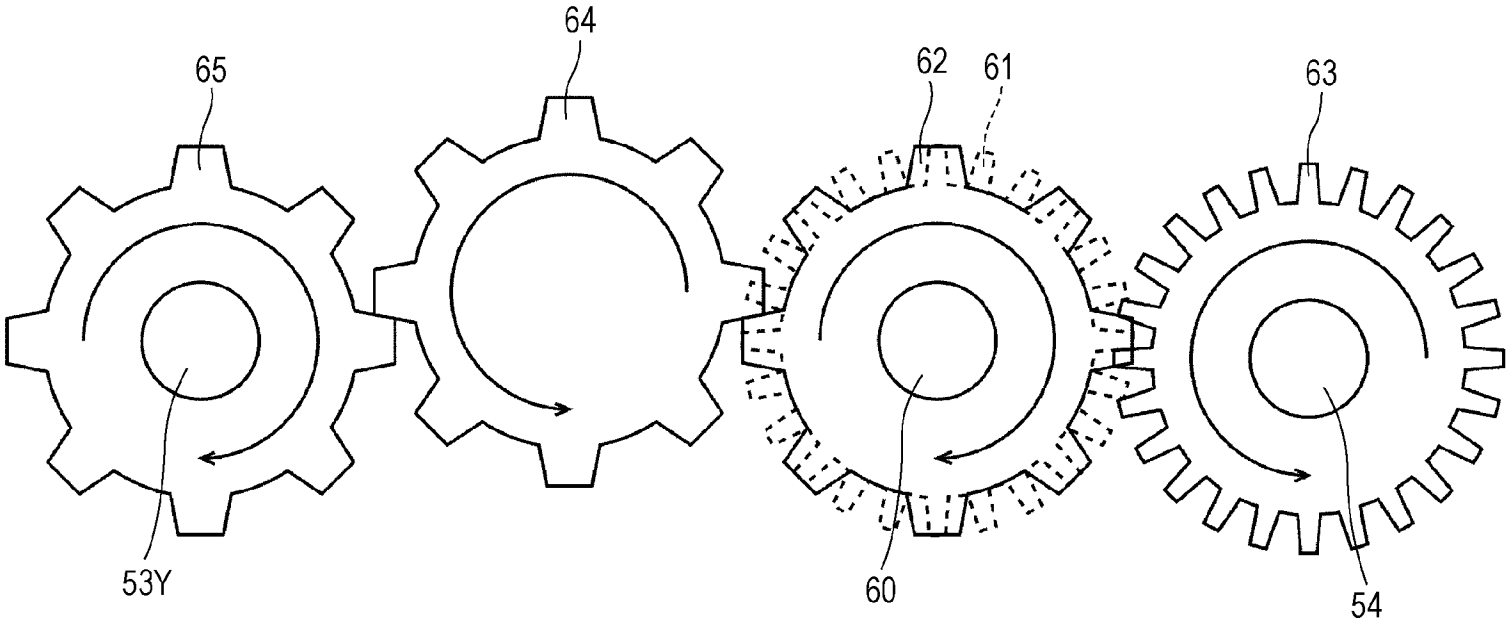
FIG. 4 is a schematic diagram illustrating a part of a drive mechanism for an intermediate transfer belt and an image formation unit.

FIG. 4 is a schematic diagram illustrating a part of a drive mechanism for the intermediate transfer belt and the image formation unit. In FIG. 4, the drive mechanism for driving the photoreceptor drum 53Y of the image formation unit 51Y is illustrated, and the drive mechanism for driving the developing roller 55Y is omitted. Furthermore, although illustration of the drive mechanism for driving the image formation units 51M, 51C, and 51K is omitted, these drive mechanisms have configurations similar to the drive mechanism for driving the image formation unit 51Y. The same applies to FIG. 9 described later.

With reference to FIG. 4, the image forming unit 140 includes the intermediate transfer belt 57 and a common motor 60 (driver) for driving the image formation units 51Y, 51M, 51C, and 51K. A bed drive gear 61, a photoreceptor drive gear 62, and a development drive gear (not illustrated) are attached to the rotating shaft of the motor 60. The belt drive gear 61 is illustrated by a dotted line. A belt driven gear 63 is attached to the rotating shaft of the drive roller 54 for the intermediate transfer belt 57. A photoreceptor driven gear 65 is attached to the rotating shaft of the photoreceptor drum 53Y. A relay gear 64 is arranged between the photoreceptor drive gear 62 and the photoreceptor driven gear 65.

A development driven gear (not illustrated) is attached to the rotating shaft of the developing roller 55Y.

The belt drive gear 61 is fitted with the belt driven gear 63. The photoreceptor drive gear 62 is fitted with the photoreceptor driven gear 65 via the relay gear 64. The development drive gear is fitted with the development driven gear. As will be described later, a backlash between the photoreceptor drive gear 62 and the photoreceptor driven gear 65, and a backlash between the development drive gear and the development driven gear are greater than a backlash between the belt drive gear 61 and the belt driven gear 63. When the motor 60 rotates in one direction, the intermediate transfer belt 57, the photoreceptor drums 53Y, 53M, 53C, and 53K, and the developing rollers 55Y, 55M, 55C, and 55K all rotate in predetermined directions. On the other hand, when the motor 60 rotates in a reverse direction, the intermediate transfer belt 57, the photoreceptor drums 53Y, 53M, 53C, and 53K, and the developing rollers 55Y, 55M, 55C, and 55K all rotate in the reverse directions to the predetermined directions described above. Thus, the photoreceptor drums 53Y, 53M, 53C, and 53K, and the developing rollers 55Y, 55M, 55C, and 55K are simultaneous drive members that rotate simultaneously with the intermediate transfer belt 57 by rotational force of the motor 60.

In this example, the image forming unit 140 does not include a clutch mechanism that disconnects connections between the motor 60 and the image formation units 51Y, 51M, 51C, and 51K. For that reason, the cost of the MFP 100 can be reduced and the size can be reduced. In the following description, rotation of the intermediate transfer belt 57, the photoreceptor drums 53Y, 53M, 53C, and 53K, and the developing rollers 55Y, 55M, 55C, and 55K during toner image transfer is referred to as forward rotation. Rotation of the intermediate transfer belt 57, the photoreceptor drums 53Y, 53M, 53C, and 53K, and the developing rollers 55Y, 55M, 55C, and 55K in a reverse direction to the forward rotation is referred to as reverse rotation. In FIG. 4, a rotation direction of each gear during forward rotation is indicated by an arrow.

Figure 5:
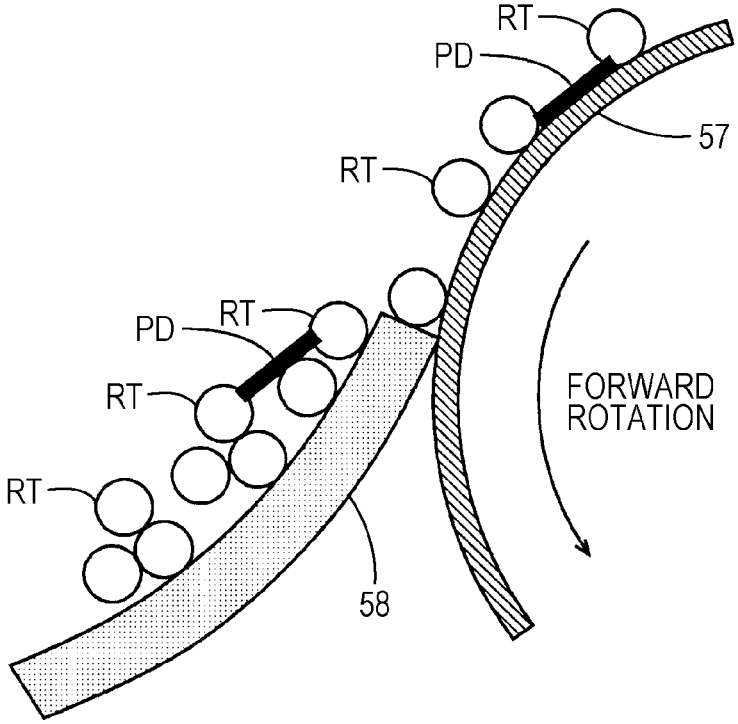
FIG. 5 is a side sectional view illustrating a cleaning blade.
Figure 6:
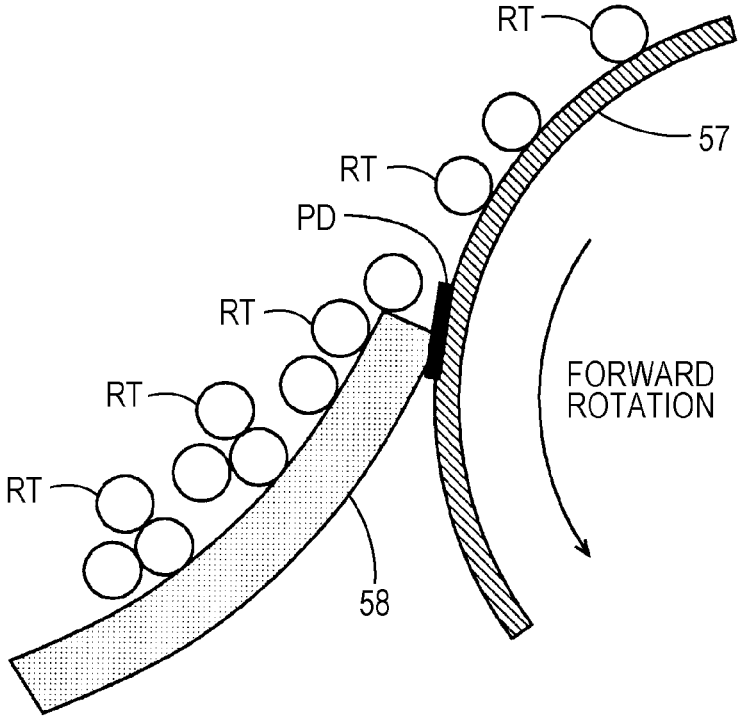
FIG. 6 is a side sectional view illustrating the cleaning blade.

The image forming unit 140 further includes a cleaning blade 58 (toner remover). FIGS. 5 and 6 are side sectional views illustrating the cleaning blade. With reference to FIG. 5, the cleaning blade 58 is feinted of, for example, a urethane rubber-based elastic body, and is arranged to be able to rub the intermediate transfer belt 57. After the toner image is transferred to the recording medium, the cleaning blade 58 removes a residual toner image RT by scraping the residual toner image RT on the intermediate transfer belt 57 with the forward rotation of the intermediate transfer belt 57. As a result, the intermediate transfer belt 57 is cleaned.

When the recording medium passes between the drive roller 54 and the secondary transfer roller 47, paper dust PD such as fine fibers or fillers generated from the recording medium may adhere to the intermediate transfer belt 57. In this case, the paper dust PD is carried to the cleaning blade 58 by the intermediate transfer belt 57, and is removed from the intermediate transfer belt 57 together with the residual toner image RT by the cleaning blade 58. However, with reference to FIG. 6, the paper dust PD is not removed by the cleaning blade 58 and may be bitten between the cleaning blade 58 and the intermediate transfer belt 57. When the paper dust PD is bitten between the cleaning blade 58 and the intermediate transfer belt 37, contact between the cleaning blade 38 and the intermediate transfer belt 57 becomes uneven, whereby cleaning failure occurs. In this case, since the residual toner image RT is not sufficiently removed, image quality degrades due to adhesion of streaky noise to the recording medium during the next image formation.

Figure 7:
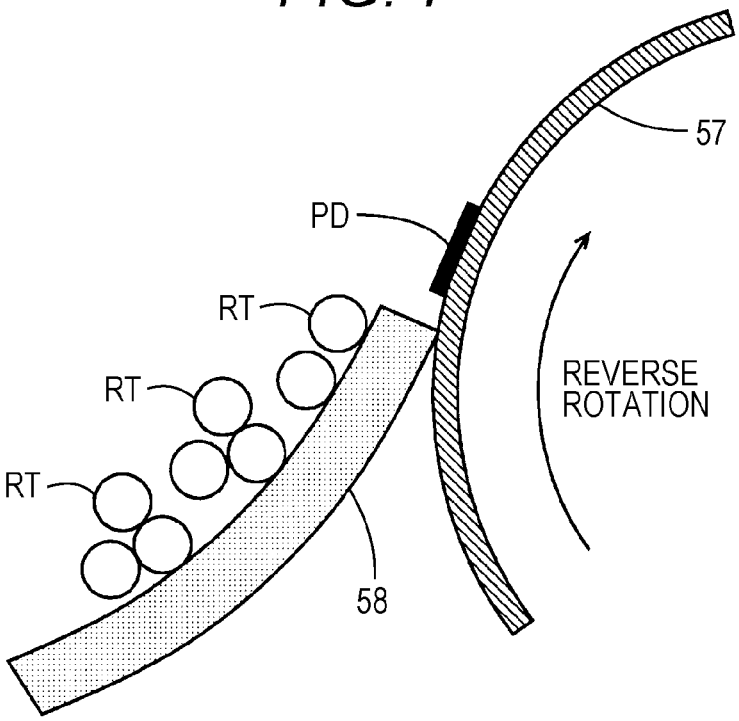
FIG. 7 is a diagram for explaining removal operation.
Figure 8:
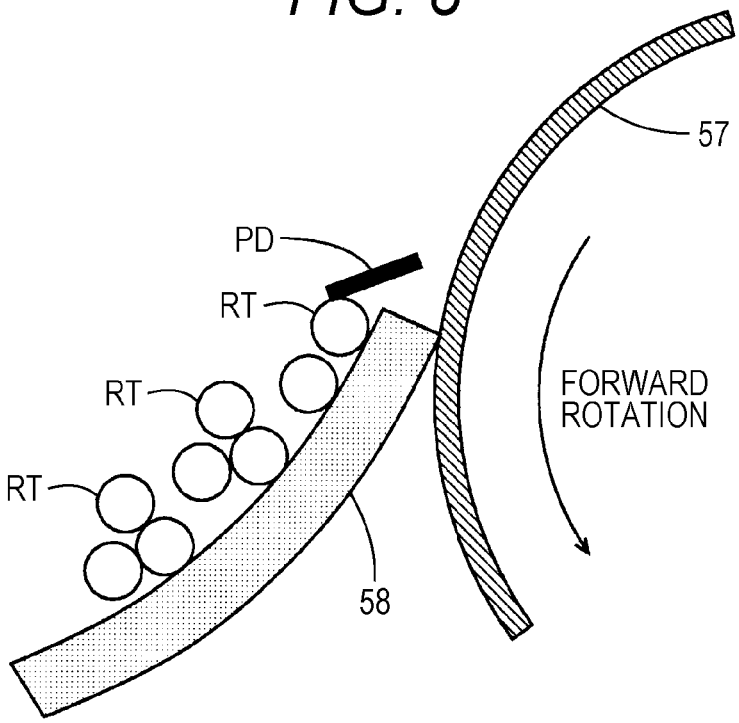
FIG. 8 is a diagram for explaining the removal operation.

Thus, removal operation is performed for removing the paper dust PD bitten between the cleaning blade 58 and the intermediate transfer belt 57. FIGS. 7 and 8 are diagrams for explaining the removal operation. With reference to FIG. 7, the intermediate transfer belt 57 is rotated in the reverse direction, whereby the bitten paper dust PD is extracted from between the cleaning blade 58 and the intermediate transfer belt 57. Thereafter, with reference to FIG. 8, the intermediate transfer belt 57 is rotated in the forward direction, whereby the paper dust PD extracted from between the cleaning blade 58 and the intermediate transfer belt 57 is scraped off by the cleaning blade 58. The removal operation is executed that includes the reverse rotation of the intermediate transfer belt 57 in FIG. 7 and the forward rotation of the intermediate transfer belt 57 in FIG. 8, whereby the paper dust PD is removed from the intermediate transfer belt 57.

The removal operation is preferably executed at a timing when the MFP 100 is stopped immediately after image forming operation is completed, for example. In this case, while the toner image in response to the print job is carried on the intermediate transfer belt 57, a foreign matter bitten between the intermediate transfer belt 57 and the cleaning blade 58 is removed. Thus, it is possible to prevent degradation of image quality in the next print job. Furthermore, image formation is not hindered by the removal operation. As a result, a decrease in productivity is prevented. However, an execution timing of the removal operation is not limited to this example, and the removal operation may be executed at any timing.

By increasing an amount of reverse rotation of the intermediate transfer belt 57 in the removal operation, it is possible to extract a larger amount of the paper dust PD bitten between the cleaning blade 58 and the intermediate transfer belt 57. However, as described above, the intermediate transfer belt 57, the photoreceptor drums 53Y, 53M, 53C, and 53K, and the developing rollers 55Y, 55M, 55C, and 55K are each driven by the common motor 60. In this case, when the amount of reverse rotation of the intermediate transfer belt 57 is increased, an amount of reverse rotation of the photoreceptor drum 53Y also increases.

When the toner adhering to the photoreceptor drum 53Y from the developing roller 55Y reaches the charging roller 54Y due to the reverse rotation of the photoreceptor drum 53Y, the charging roller 54Y may be contaminated and poor charging of the photoreceptor drum 53Y may occur. Furthermore, during the reverse rotation of the photoreceptor drum 53Y, an amount of a developer conveyed from the developing roller 55Y to the photoreceptor drum 53Y is not adjusted. For that reason, a large amount of the developer is conveyed to the photoreceptor drum 53Y, whereby clogging of the developer may occur. Furthermore, when the developer is a two-component developer containing the toner and a carrier, the carrier may adhere to the photoreceptor drum 53Y. These problems also occur similarly in the photoreceptor drums 53M, 53C, and 53K.

Figure 9:
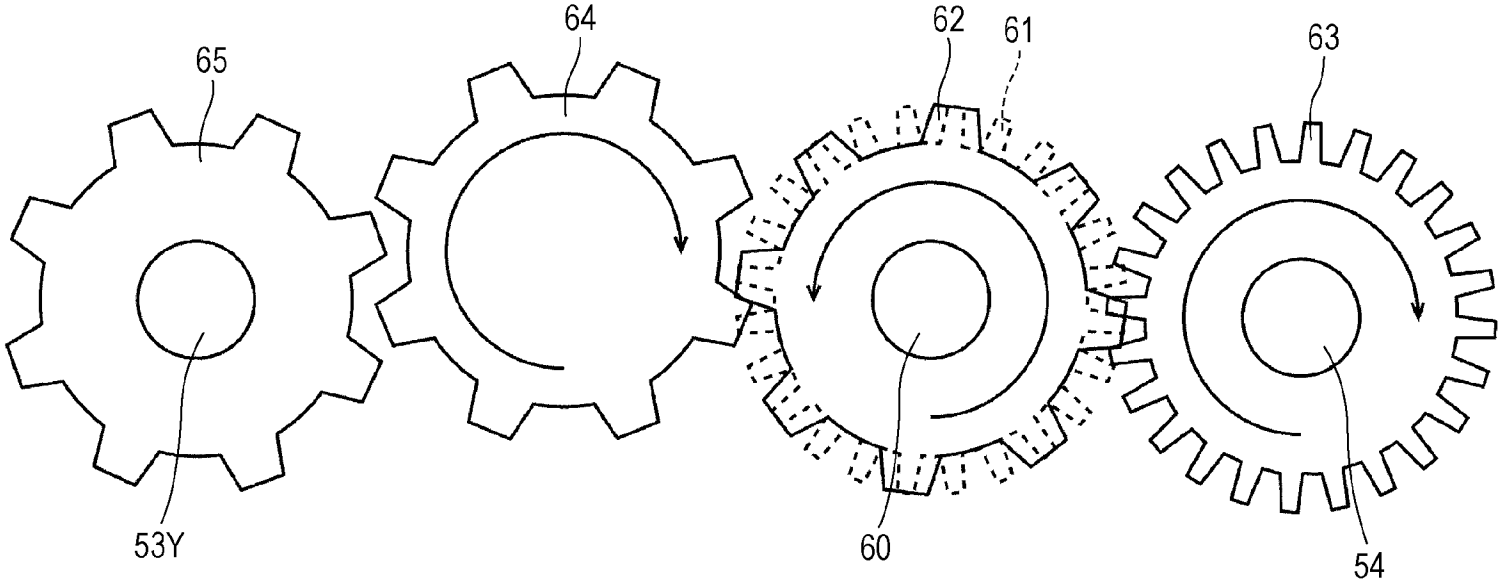
FIG. 9 is a schematic diagram illustrating a part of the drive mechanism for the intermediate transfer belt and the image formation unit during reverse rotation.

FIG. 9 is a schematic diagram illustrating a part of the drive mechanism for the intermediate transfer belt and the image formation unit during the reverse rotation. With reference to FIG. 9, to prevent the problems described above, the amount of reverse rotation of the intermediate transfer belt 57 in the removal operation is limited so that the photoreceptor drums 53Y, 53M, 53C, and 53K, and the developing rollers 55Y, 55M, 55C, and 55K do not rotate in the reverse direction even if the intermediate transfer belt 57 rotates in the reverse direction.

Specifically, the backlash between the photoreceptor drive gear 62 and the photoreceptor driven gear 65 is larger than the backlash between the belt drive gear 61 and the belt driven gear 63. Furthermore, the backlash between the development drive gear and the development driven gear (not illustrated) is larger than the backlash between the belt dive gear 61 and the belt driven gear 63. Thus, the amount of reverse rotation of the intermediate transfer belt 57 in the removal operation is made less than the backlash between the photoreceptor drive gear 62 and the photoreceptor driven gear 65, and less than the backlash between the development drive gear and the development driven gear.

That is, an amount of rotation of the motor 60 during the reverse rotation is made greater than or equal to the backlash between the belt drive gear 61 and the belt driven gear 63, less than the backlash between the photoreceptor drive gear 62 and the photoreceptor driven gear 65, and less than the backlash between the development drive gear and the development driven gear. As a result, as illustrated by arrows in FIG. 9, even when the belt driven gear 63 (intermediate transfer belt 57) rotates in the reverse direction due to the rotation of the motor 60 in the reverse direction, the photoreceptor driven gear 65 (photoreceptor drum 53Y)) is prevented from rotating in the reverse direction. Similarly, the developing roller 55Y is prevented from rotating in the reverse direction.

Furthermore, by executing the removal operation a plurality of times, it is possible to increase the total amount of reverse rotation of the intermediate transfer belt 57 while limiting the amount of reverse rotation of the intermediate transfer belt 57 per removal operation. In each removal operation, an amount of rotation of the intermediate transfer belt 57 during the forward rotation is preferably larger than the amount of rotation of the intermediate transfer belt 57 during the reverse rotation. As a result, the foreign matter extracted from between the intermediate transfer belt 57 and the cleaning blade 58 due to the reverse rotation of the intermediate transfer belt 57 can be reliably removed by the forward rotation of the intermediate transfer belt 57. Furthermore, even when the removal operation is repeated, it is possible to reliably prevent the photoreceptor drums 53Y, 53M, 53C, and 53K, and the developing rollers 55Y, 55M, 55C, and 55K, from rotating in the reverse direction.

As described above, in this example, even when the intermediate transfer belt 57 rotates in the reverse direction, operation of the motor 60 is controlled so that the photoreceptor drums 53Y, 53M, 53C, and 53K, and the developing rollers 55Y, 55M, 55C, and 55K do not rotate in the reverse direction; however, the embodiment is not limited thereto. When amounts of reverse rotation of the photoreceptor drums 53Y, 53M, 53C, and 53K, and the developing rollers 55Y, 55M, 55C, and 55K are less than or equal to a certain amount, the problems described above do not occur. For that reason, when the intermediate transfer belt 57 rotates in the reverse direction, the operation of the motor 60 may be controlled so that the amounts of reverse rotation of the photoreceptor drums 53Y, 53M, 53C, and 53K, and the developing rollers 55Y, 55M, 55C, and 55K are less than or equal to the certain amount. Furthermore, in each removal operation, the amount of rotation of the intermediate transfer belt 57 during the forward rotation may be equal to or slightly smaller than the amount of rotation of the intermediate transfer belt 57 during the reverse rotation.

Figure 10:
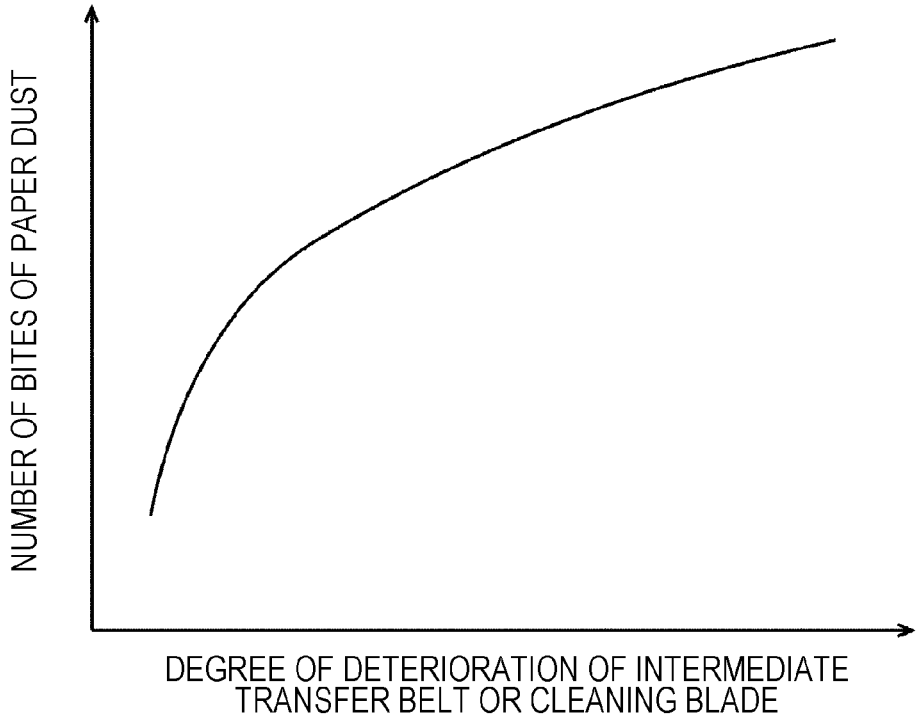
FIG. 10 is a graph illustrating a relationship between the degree of deterioration of the intermediate transfer belt or the cleaning blade and the number of bites of paper dust.

The number of pieces of the paper dust PD bitten between the cleaning blade 58 and the intermediate transfer belt 57 (the number of bites) vanes depending on the degree of deterioration of the intermediate transfer belt 57 or the cleaning blade 58. FIG. 10 is a graph illustrating a relationship between the degree of deterioration of the intermediate transfer belt or the cleaning blade and the number of bites of paper dust. With reference to FIG. 10, when the degree of deterioration of the intermediate transfer belt 57 or the cleaning blade 58 is small, the number of bites of the paper dust PD is small. On the other hand, due to aged deterioration, the surface of the intermediate transfer belt 57 is roughened, and the cleaning blade 58 is deformed or worn. When the degree of deterioration of the intermediate transfer belt 57 or the cleaning blade 58 becomes large in this way, the number of bites of the paper dust PD increases.

Figure 11:
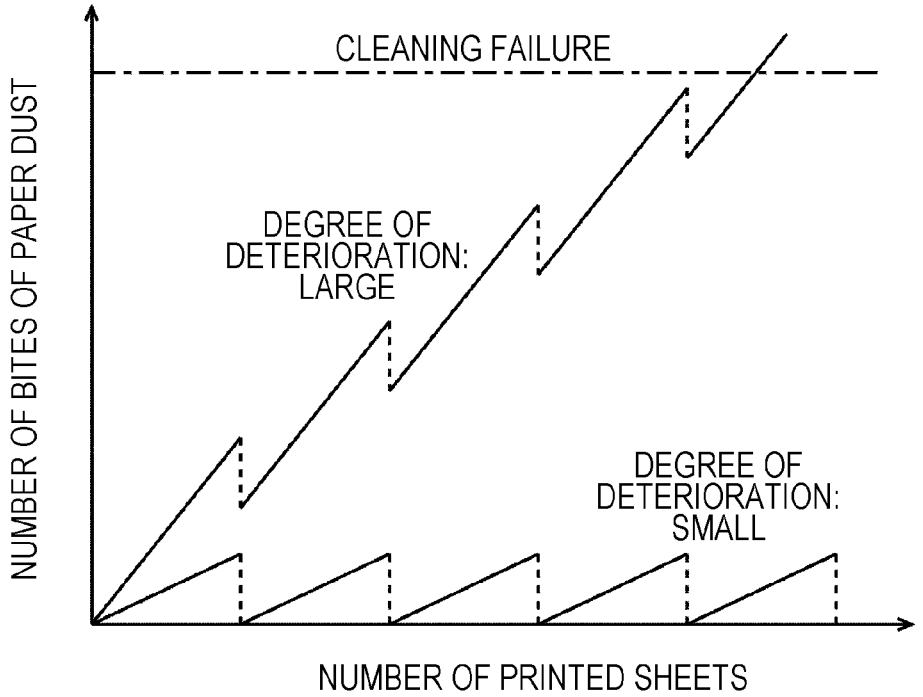
FIG. 11 is a graph illustrating a change in the number of bites of paper dust when the removal operation is performed.
Figure 12:
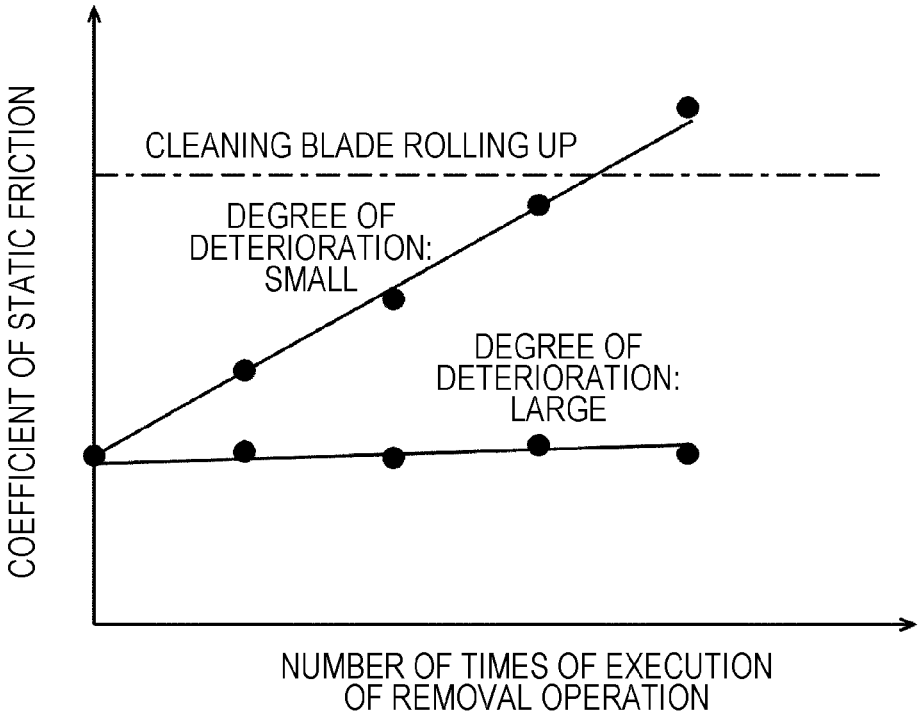
FIG. 12 is a graph illustrating a change in a coefficient of static friction between the intermediate transfer belt and the cleaning blade when the number of times of execution of the removal operation is changed.

FIG. 11 is a graph illustrating a change in the number of bites of paper dust when the removal operation is performed. FIG. 12 is a graph illustrating a change in a coefficient of static friction between the intermediate transfer belt and the cleaning blade when the number of times of execution of the removal operation is changed. In FIG. 11, the removal operation is performed every time a print job of a certain number of sheets is completed. Furthermore, the change in the number of bites of the paper dust PD due to the forward rotation of the intermediate transfer belt 57 during the image forming operation is indicated by a solid line, and the change in the number of bites of the paper dust PD due to the reverse rotation of the intermediate transfer belt 57 during the removal operation is indicated by a dotted line. The same applies to FIG. 13 described later.

With reference to FIG. 11, when the degree of deterioration of the intermediate transfer belt 57 or the cleaning blade 58 is small, the number of bites of the paper dust PD is small, so that the paper dust PD bitten can be sufficiently removed each time the removal operation is executed once. On the other hand, when the removal operation is executed, a lubricant supplied to the tip of the cleaning blade 58 is removed by the cleaning blade 58 together with the residual toner image FT and the paper dust PD. For that reason, with reference to FIG. 12, when the number of times of execution of the removal operation is increased in a state where the degree of deterioration of the intermediate transfer belt 57 or the cleaning blade 58 is small, the lubricant is excessively removed, whereby a coefficient of static friction between the intermediate transfer belt 57 and the cleaning blade 58 increases. When the coefficient of static friction increases to a certain value or more, rolling up of the cleaning blade 58 occurs.

When the degree of deterioration of the intermediate transfer belt 57 or the cleaning blade 58 is large, the number of bites of the paper dust PD is large, so that the paper dust PD bitten cannot be sufficiently removed by executing the removal operation only once. Thus, when the number of times of execution of the removal operation is small, the number of bites of the paper dust PD increases as the number of printed sheets increases. When the number of bites of the paper dust PD increases to a certain value or more, cleaning failure occurs. On the other hand, since the coefficient of static friction between the intermediate transfer belt 57 and the cleaning blade 58 decreases in a state where the intermediate transfer belt 57 or the cleaning blade 58 is deteriorated, the rolling up of the cleaning blade 58 hardly occurs even if the lubricant supplied to the tip of the cleaning blade 58 is exhausted.

Figure 13:
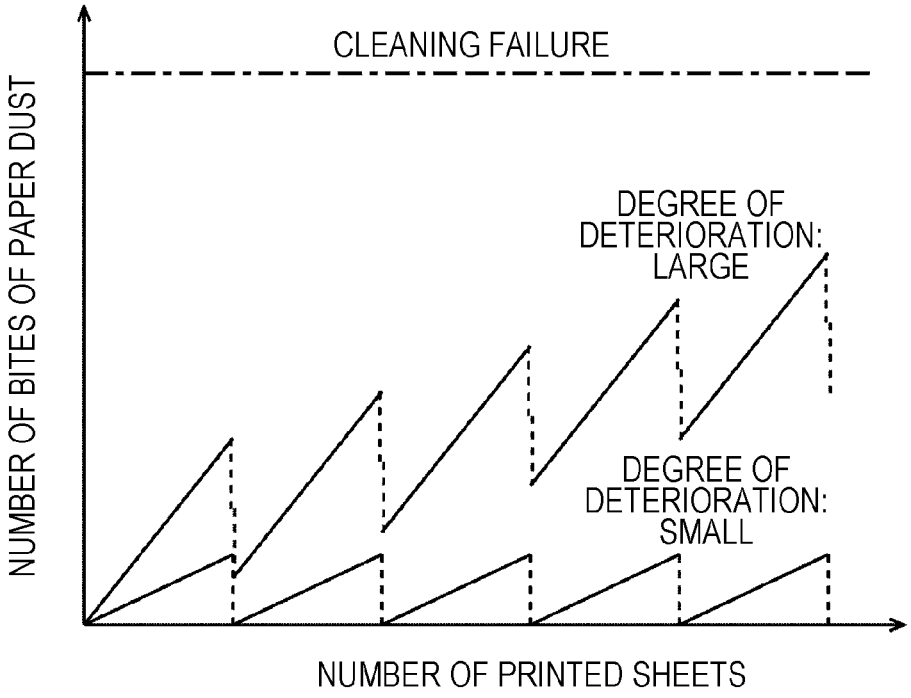
FIG. 13 is a graph illustrating a change in the number of bites of paper dust when the number of times of execution of the removal operation is changed.

Thus, the number of times of execution of the removal operation is changed depending on the degree of deterioration of the intermediate transfer belt 57 or the cleaning blade 58. FIG. 13 is a graph illustrating a change in the number of bites of paper dust when the number of times of execution of the removal operation is changed With reference to FIG. 13, when the degree of deterioration of the intermediate transfer belt 57 or the cleaning blade 58 is small, the number of times of execution of the removal operation is determined to be one. In this case, similarly to the example of FIG. 11, the paper dust PD bitten can be sufficiently removed each time the removal operation is executed once. On the other hand, when the degree of deterioration of the intermediate transfer belt 57 or the cleaning blade 58 is large, the number of times of execution of the removal operation is determined to be two. According to this configuration, the number of bites of the paper dust PD is reduced as compared with the example of FIG. 11. As a result, it is possible to delay a time until the cleaning failure occurs.

Figure 14:
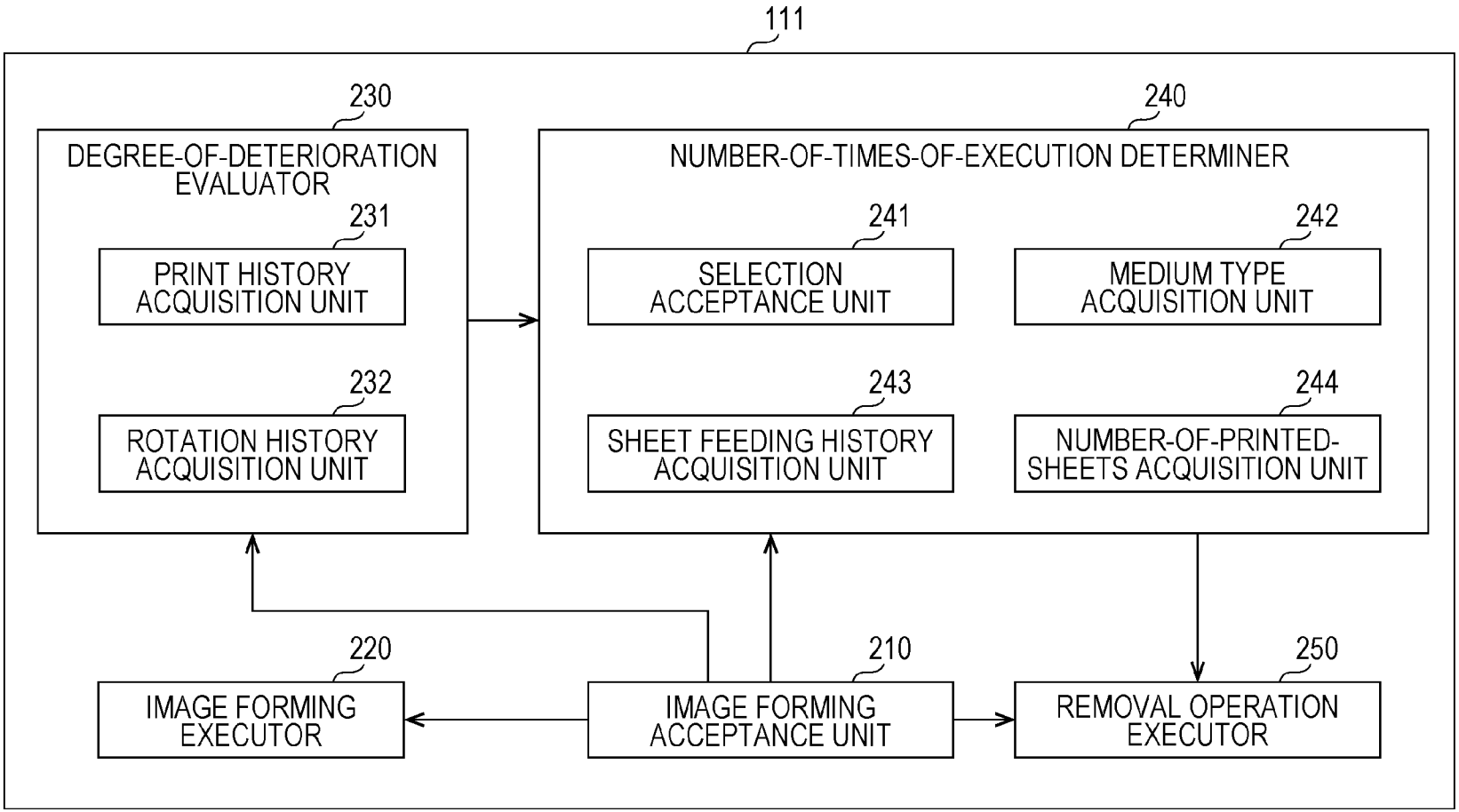
FIG. 14 is a diagram illustrating; an example of functions possessed by a CPU of the MFP in an embodiment of the present invention.

FIG. 14 is a diagram illustrating an example of functions of the CPU of the MFP in the present embodiment. The functions illustrated in FIG. 14 are functions implemented by the CPU 111, by executing a recording medium conveying program stored in the ROM 113, HDD 115, or CD-ROM 118A by the CPU 111 included in the MFP 100. With reference to FIG. 14, the CPU 111 includes an image forming acceptance unit 210, an image forming executor 220, a degree-of-deterioration evaluator 230, a number-of-times-of-execution determiner 240, and a removal operation executor 250. The image forming acceptance unit 210 accepts an image formation execution instruction from the user as a print job including images of one or more pages. The image forming executor 220 controls the image forming unit 140 to cause the intermediate transfer belt 57 to carry a toner image corresponding to the page for each page in response to acceptance of the print job by the image forming acceptance unit 210, and controls the sheet feeding unit 150 to convey the recording medium, to execute image formation on the recording medium.

The degree-of-deterioration evaluator 230 evaluates the degree of deterioration of the intermediate transfer belt 57 or the cleaning blade 58. In response to acceptance of the print job by the image forming acceptance unit 210, the degree of deterioration of the intermediate transfer belt 57 or the cleaning blade 58 may be evaluated on the basis of a part or all of a surface roughness of the intermediate transfer belt 57, a degree of wear of the cleaning blade 58, or a distortion of the cleaning blade 58.

In this example, the degree-of-deterioration evaluator 230 includes a print history acquisition unit 231 and a rotation history acquisition unit 232. The print history acquisition unit 231 acquires the total number of sheets of the recording medium subjected to image formation (printing) by the MFP 100 as a print history. The rotation history acquisition unit 232 acquires the total amount of rotation of the intermediate transfer belt 37 as a rotation history. The degree-of-deterioration evaluator 230 evaluates the degree of deterioration of the intermediate transfer belt 57 or the cleaning blade 58 on the basis of at least one of the print history acquired by the print history acquisition unit 231 or the rotation history acquired by the rotation history acquisition unit 232.

The number-of-times-of-execution determiner 240 determines the number of times of execution of the removal operation depending on the degree of deterioration of the intermediate transfer belt 57 or the cleaning blade 58 evaluated by the degree-of-deterioration evaluator 230. A relationship between the degree of deterioration of the intermediate transfer belt 57 or the cleaning blade 58 and the number of times of execution of the removal operation is determined in advance. An example will be described later of the relationship between the degree of deterioration of the intermediate transfer belt 57 or the cleaning blade 58 and the number of times of execution of the removal operation.

In this example, the number-of-times-of-execution determiner 240 includes a selection acceptance unit 241, a medium type acquisition unit 242, a sheet feeding history acquisition unit 243, and a number-of-printed-sheets acquisition unit 244. The selection acceptance unit 241 accepts selection of the number of times of execution of the removal operation. The user can select the number of times of execution of the removal operation by operating the operation unit 163 of the operation panel 160. When the selection of the number of times of execution of the removal operation is accepted by the selection acceptance unit 241, the number-of-times-of-execution determiner 240 determines the number of times of execution selected by the user without determining the number of times of execution of the removal operation depending on the degree of deterioration of the intermediate transfer belt 57 or the cleaning blade 58. Note that, the number-of-times-of-execution determiner 240 may determine the number of times of execution of the removal operation depending on the degree of deterioration of the intermediate transfer belt 57 or the cleaning blade 58, and then change the number of times of execution to the number of times of execution selected by the user.

The medium type acquisition unit 242 acquires a type of the recording medium on which an image is formed. The type of the recording medium includes, for example, a plain sheet, a high quality sheet, a recycled sheet, a photographic sheet, and an OHP film. The type of the recording medium may be acquired on the basis of the user's selection. Alternatively, when there is a sensor for identifying the type of the recording medium in the sheet feeding unit 150, the type of the recording medium may be acquired on the basis of an identification result by the sensor. When the type of the recording medium is acquired by the medium type acquisition unit 242, the number-of-times-of-execution determiner 240 corrects the number of times of execution of the determined removal operation on the basis of the type of the recording medium acquired. For example, an amount of the paper dust PD bitten between the cleaning blade 58 and the intermediate transfer belt 57 when the recording medium is a recycled sheet is greater than an amount of the paper dust PD bitten between the cleaning blade 58 and the intermediate transfer belt 57 when the recording medium is a plain sheet. For that reason, when the recording medium is a recycled sheet, correction is performed so that the number of times of execution of the removal operation is greater than that in a case where the recording medium is a plain sheet.

The sheet feeding history acquisition unit 243 acquires an amount of use (for example, total amount of rotation) of the sheet feeding rollers 151*r*, 152*r*, 153*r*, and 154*r* as a sheet feeding history. When the sheet feeding history is acquired by the sheet feeding history acquisition unit 243, the number-of-times-of-execution determiner 240 corrects the number of times of execution of the determined removal operation on the basis of the acquired sheet feeding history. The larger the amount of use of the sheet feeding rollers 151*r*, 152*r*, 153*r*, and 154*r*, the larger the amount of the paper dust PD adhering to the sheet feeding rollers 151*r*, 152*r*, 153*f*, and 154*r*. For this reason, the larger the amount of use of the sheet feeding rollers 151*r*, 152*r*, 153*r*, and 154*r*, the larger the amount of the paper dust PD conveyed together with the recording medium. For example, the amount of the paper dust PD bitten between the cleaning blade 58 and the intermediate transfer belt 57 when the sheet feeding history is long is greater than the amount of the paper dust PD bitten between the cleaning blade 58 and the intermediate transfer belt 57 when the sheet feeding history is short. For that reason, when the sheet feeding history is long, correction is performed so that the number of times of execution of the removal operation is larger than that in a case where the sheet feeding history is short.

The number-of-printed-sheets acquisition unit 244 acquires the number of copies of the recording medium on which image formation is executed in the print job as the number of printed sheets. When the number of printed sheets is acquired by the number-of-printed-sheets acquisition unit 244, the number-of-times-of-execution determiner 240 corrects the number of times of execution of the determined removal operation on the basis of the acquired number of printed sheets. An example of a relationship between the number of printed sheets and the number of times of execution of the removal operation will be described later.

When two or more pieces of information among the type of the recording medium, the sheet feeding history, and the number of printed sheets are acquired, the number of times of execution of the removal operation may be corrected as the total number of times of execution based on each of the two or more pieces of information acquired. On the other hand, depending on a combination of the two or more pieces of information among the type of the recording medium, the sheet feeding history, and the number of printed sheets, the appropriate number of times of execution of the removal operation may differ from the total number of times of execution based on each of the two or more pieces of information acquired. For that reason, when the two or more pieces of information, among the type of the recording medium, the sheet feeding history, and the number of printed sheets are acquired, the number of times of execution of the removal operation may be corrected on the basis of the combination of the two or more pieces of information acquired. A relationship between the combination of the two or more pieces of information among the type of the recording medium, the sheet feeding history, and the number of printed sheets and the appropriate number of times of execution of the removal operation may be stored in advance as a table in the HDD 115 or the like.

The removal operation executor 250 drives the intermediate transfer belt 57 so that the removal operation is executed the number of times determined or corrected by the number-of-times-of-execution determiner 240. During the reverse rotation in the removal operation, the amount of rotation of the intermediate transfer belt 57 is limited to a predetermined constant amount of rotation so that the photoreceptor drums 53Y, 53M, 53C, and 53K, and the developing rollers 55Y, 55M, 55C, and 55K do not rotate in the reverse direction. Furthermore, during the forward rotation in the removal operation, an absolute value of the amount of rotation of the intermediate transfer belt 57 is made larger than an absolute value of the amount of rotation of the intermediate transfer belt 57 during the reverse rotation.

Moreover, in this example, when there is the next print job, execution of the forward rotation of the intermediate transfer belt 57 in the final removal operation is omitted. Even when the execution of the forward rotation of the intermediate transfer belt 57 in the final removal operation is omitted, a foreign matter extracted from between the intermediate transfer belt 57 and the cleaning blade 58 due to the reverse rotation of the intermediate transfer belt 57 in the final removal operation is removed by the first forward rotation of the intermediate transfer belt 57 during image formation corresponding to the next job. For this reason, a removal operation time is shortened while cleaning performance by the cleaning blade 58 is maintained, whereby image formation corresponding to the next job can be performed at high speed. That is, the image formation corresponding to the next print job can be started quickly. On the other hand, even when there is the next print job, the execution of the forward rotation of the intermediate transfer belt 57 in the final removal operation may be executed without being omitted.

Figure 15:
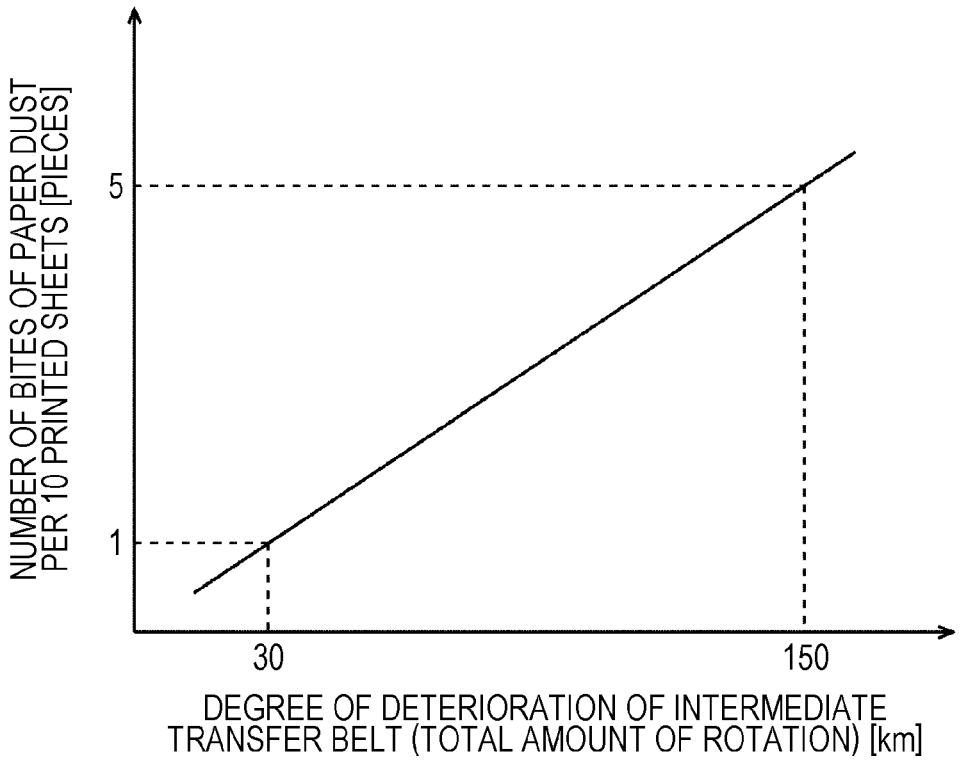
FIG. 15 is a graph illustrating an example of a relationship between the degree of deterioration of the intermediate transfer belt and the number of bites of paper dust.

FIG. 15 is a graph illustrating an example of a relationship between the degree of deterioration of the intermediate transfer belt and the number of bites of paper dust. With reference to FIG. 15, when the degree of deterioration of the intermediate transfer belt 57 is small, specifically, when the total amount of rotation of the intermediate transfer belt 57 is 30 km, the number of bites of the paper dust PD per 10 printed sheets of the recording medium is one. On the other hand, when the degree of deterioration of the intermediate transfer belt 57 is large, specifically, when the total amount of rotation of the intermediate transfer belt 57 is 150 km, the number of bites of the paper dust PD per 10 printed sheets of the recording medium is five. Thus, the number of bites of the paper dust PD is proportional to the degree of deterioration of the intermediate transfer belt 57.

According to the example of FIG. 15, when continuous printing is performed on 50 recording media when the degree of deterioration of the intermediate transfer belt 57 is small, the number of bites of the paper dust PD is five. When continuous printing is performed on 50 recording media when the degree of deterioration of the intermediate transfer belt 57 is large, the number of bites of the paper dust PD is 25. Here, when the removal operation is performed once, about 30% of the paper dust PD bitten is removed, and the remaining 70% remains without being removed.

Figure 16:
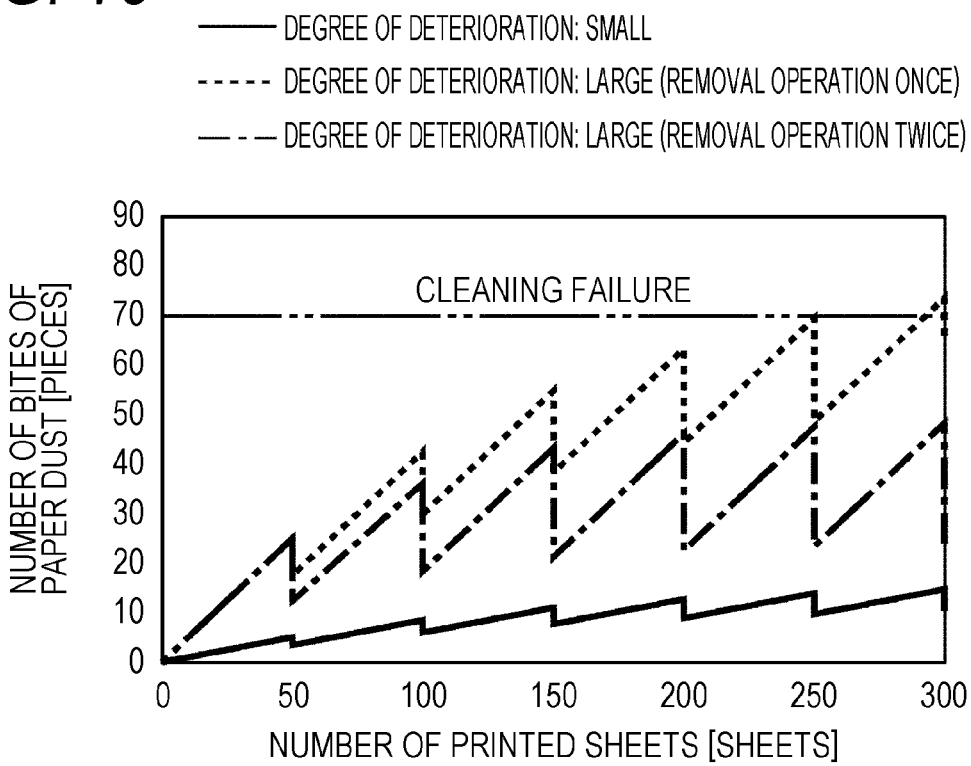
FIG. 16 is a graph illustrating an example of a relationship between the number of printed sheets and the number of bites of paper dust.

FIG. 16 is a graph illustrating an example of a relationship between the number of printed sheets and the number of bites of paper dust. With reference to FIG. 16, the removal operation is performed every time the print job of 50 printed sheets is completed. Here, when the degree of deterioration of the intermediate transfer belt 57 is small, the number of bites of the paper dust PD can be sufficiently reduced each time the removal operation is executed once. However, when the degree of deterioration of the intermediate transfer belt 57 is large, it is not possible to sufficiently reduce the number of bites of the paper dust PD by only one removal operation. For that reason, cleaning failure occurs when five to six print jobs are responded. On the other hand, when the removal operation is executed twice when the degree of deterioration of the intermediate transfer belt 57 is large, the number of bites of the paper dust PD can be sufficiently reduced. This prevents cleaning failure from occurring.

Figure 17:
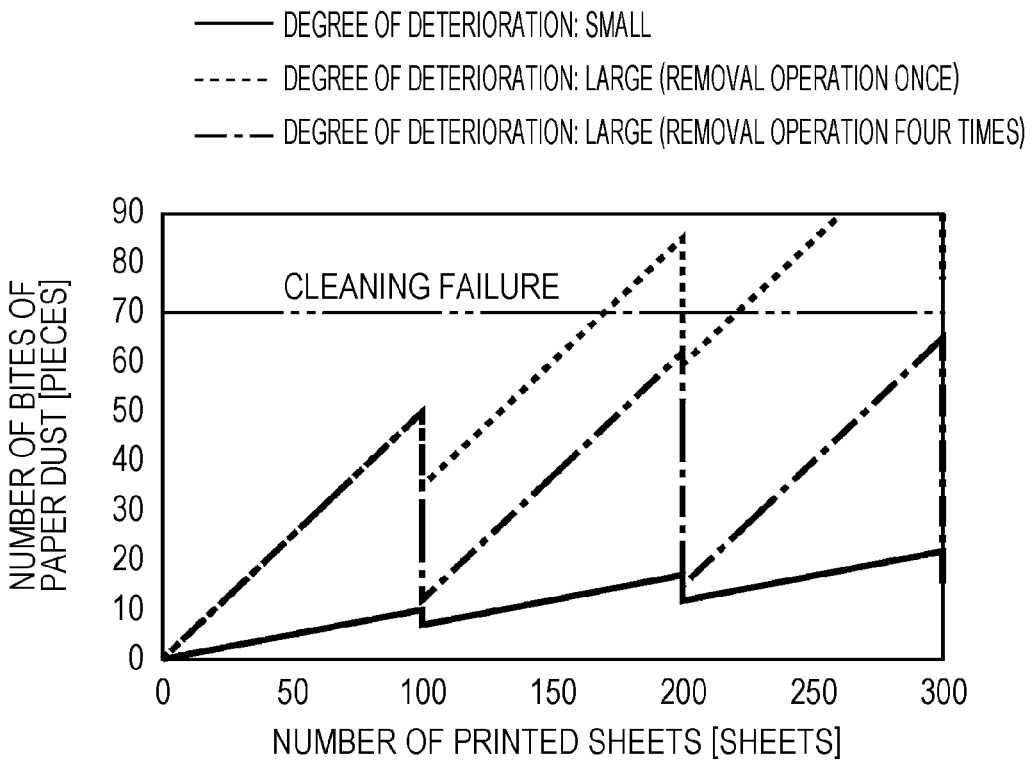
FIG. 17 is a graph illustrating another example of the relationship between the number of printed sheets and the number of bites of paper dust.

FIG. 17 is a graph illustrating another example of the relationship between the number of printed sheets and the number of bites of paper dust. With reference to FIG. 17, the removal operation is performed every time the print job of 100 printed sheets is completed. In this case, similarly to the example of FIG. 16, when the degree of deterioration of the intermediate transfer belt 57 is small, the number of bites of the paper dust PD can be sufficiently reduced each time the removal operation is executed once. However, when the degree of deterioration of the intermediate transfer belt 57 is large, it is not possible to sufficiently reduce the number of bites of the paper dust PD by only one removal operation. For that reason, cleaning failure occurs when two to three print jobs are responded. On the other hand, when the removal operation is executed four times when the degree of deterioration of the intermediate transfer belt 57 is large, the number of bites of the paper dust PD can be sufficiently reduced. This prevents cleaning failure from occurring.

As described above, the number of times of execution of the removal operation is determined corresponding to the degree of deterioration of the intermediate transfer belt 57 or the cleaning blade 58 so that the cleaning failure does not occur, on the basis of a relationship between the degree of deterioration of the intermediate transfer belt 57 or the cleaning blade 58 illustrated in FIG. 15 and the number of bites of the paper dust PD. Furthermore, the number of times of execution of the removal operation is corrected on the basis of the number of printed sheets in the print job so that cleaning failure does not occur.

Figure 18:
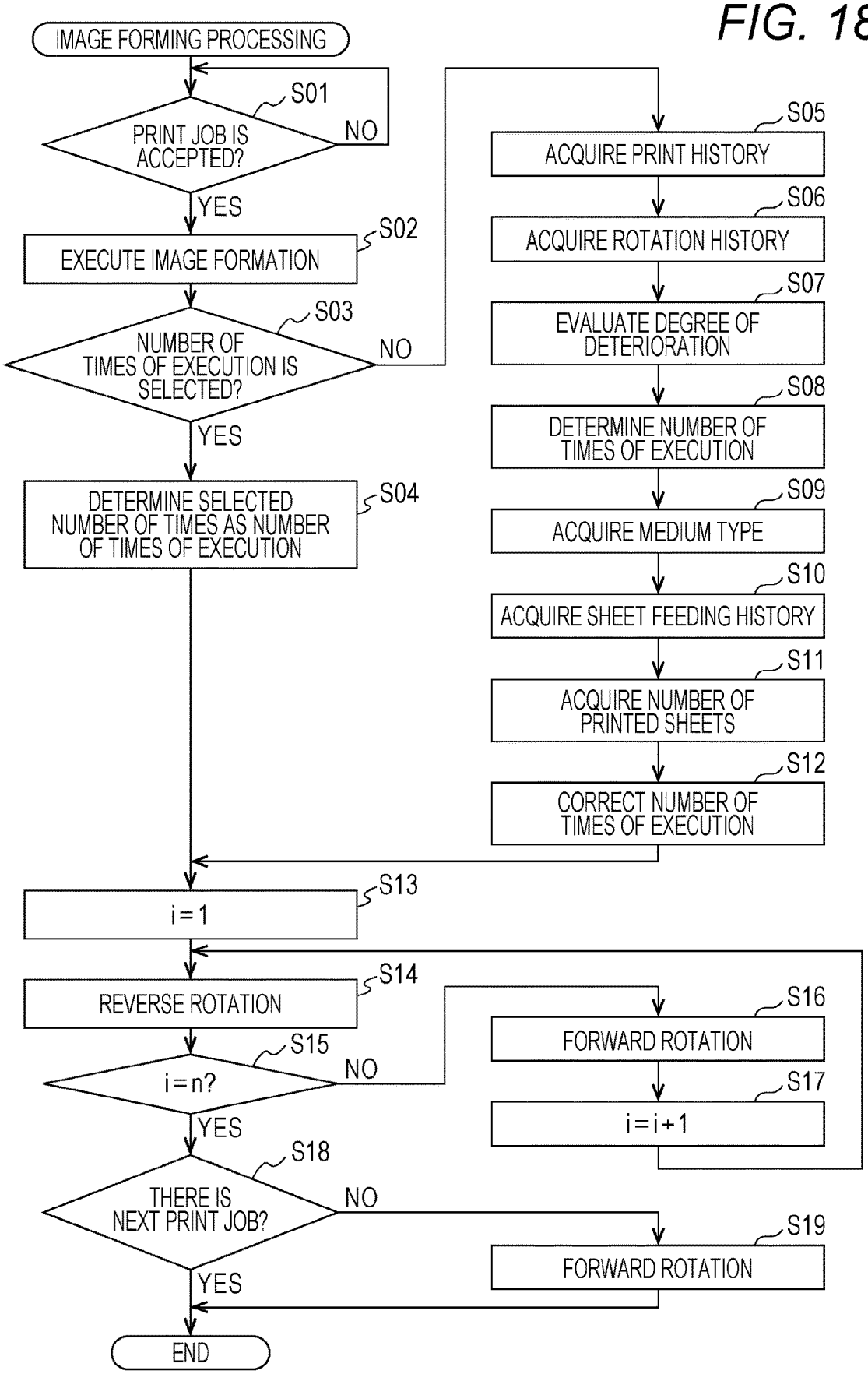
FIG. 18 is a flowchart illustrating an example of a flow of image forming processing.

FIG. 18 is a flowchart illustrating an example of a flow of image forming processing. The image forming processing is processing executed by the CPU 111, by executing an image forming program by the CPU 111 included in the MFP 100. With reference to FIG. 18, the CPU 111 included in the MFP 100 determines whether or not a print job is accepted (step S01). The CPU 111 is in a standby state until the print job is accepted (NO in step S01), and if the print job is accepted (YES in step S01), the processing proceeds to step S02. In step S02, image formation (printing) is executed, and the processing proceeds to step S03.

In step S03, it is determined whether or not the number of times of execution of the removal operation is selected by the user. If the number of times of execution of the removal operation is selected by the user, the processing proceeds to step S04, otherwise the processing proceeds to step S05. In step S04, the number of times of execution selected by the user is determined as the number of times of execution of the removal operation, and the processing proceeds to step S13.

In step S05, the print history is acquired, and the processing proceeds to step S06. In step S06, the rotation history of the intermediate transfer belt 57 is acquired, and the processing proceeds to step S07. Any of step S05 and step S06 may be executed first, or may be executed at the same time. In step S07, the degree of deterioration of the intermediate transfer belt 57 or the cleaning blade 58 is evaluated on the basis of at least one of the print history or the rotation history of the intermediate transfer belt 57, and the processing proceeds to step S08. In step S08, the number of times of execution of the removal operation is determined depending on the degree of deterioration of the intermediate transfer belt 57 or cleaning blade 58 evaluated, and the processing proceeds to step S09.

In step S09, the type of the recording medium on which the image is formed is acquired in step S02, and the processing proceeds to step S10. In step S10, the sheet feeding history is acquired, and the processing proceeds to step S11. In step S11, the number of printed sheets in the print job is acquired, and the processing proceeds to step S12. Any of step S09, step S10, and step S11 may be executed first, or may be executed at the same time. In step S12, the number of times of execution of the removal operation determined in step S08 is corrected on the basis of the type of the recording medium, the sheet feeding history, or the number of printed sheets acquired, and the processing proceeds to step S13.

In step S13, a value of a variable i is set to 1, and the processing proceeds to step S14. In step S14, the intermediate transfer belt 57 is rotated in the reverse direction, and the processing proceeds to step S15. In step S15, it is determined whether or not the value of the variable i is n. Here, n is the number of times of execution of the removal operation determined in step S04 or corrected in step S12. If the value of the variable i is ii, the processing proceeds to step S18, otherwise the processing proceeds to step S16. In step S16, the intermediate transfer belt 57 is rotated in the forward direction, and the processing proceeds to step S17. In step S17, the value of the variable i is updated to i+1, and the processing proceeds to step S14. Steps S14 to S17 are repeated until the value of the variable i becomes n.

In step S18, it is determined whether or not there is a next print job. If there is a next print job, the image forming processing ends without the forward rotation in the final (nth) removal operation. In this case, another image forming processing corresponding to the next print job is started. If there is no next print job, the processing proceeds to step S19. In step S19, the forward rotation in the final (nth) removal operation is executed, and the image forming processing is completed.

Modifications

The intermediate transfer belt 57, the photoreceptor drums 53Y, 53M, 53C, and 53K, and the developing rollers 55Y, 55M, 55C, and 55K are driven by the common motor 60; however, the embodiment is not limited thereto. The intermediate transfer belt 57 and the photoreceptor drums 53Y, 53M, 53C, and 53K may be driven by the same motor 60, and the developing rollers 55Y, 55M, 55C, and 55K may be driven by another motor. Alternatively, the intermediate transfer belt 57 and the developing rollers 55Y, 55M, 55C, and 55K may be given by the same motor 60, and the photoreceptor drums 53Y, 53M, 53C, and 53K may be driven by another motor.

Furthermore, the number of times of execution of the removal operation is determined depending on the degree of deterioration of the intermediate transfer belt 57 or the cleaning blade 58, and then corrected on the basis of at least one of the type of the recording medium, the sheet feeding history, or the number of printed sheets; however, the embodiment is not limited thereto. The number of times of execution of the removal operation may be determined on the basis of at least one of the type of the recording medium, the sheet feeding history, or the number of printed sheets, in addition to the degree of deterioration of the intermediate transfer belt 57 or the cleaning blade 58. Alternatively, the number of times of execution of the removal operation is determined depending on the degree of deterioration of the intermediate transfer belt 57 or the cleaning blade 58, and does not have to be corrected on the basis of the type of the recording medium, the sheet feeding history, and the number of printed sheets. In this case, steps S05 to S12 of the image forming processing are omitted.

As described above, the MFP 100 in the present embodiment functions as an image forming apparatus, the intermediate transfer belt 57 carries a toiler image including toner, and the motor 60 rotates the intermediate transfer belt 57. The cleaning blade 58 comes in contact with the intermediate transfer belt 57 and removes the toner remaining on the intermediate transfer belt 57 while the intermediate transfer belt 57 is rotated in the forward direction by the motor 60. In the MFP 100, the degree of deterioration of the intermediate transfer belt 57 or the cleaning blade 58 is evaluated, and on the basis of the degree of deterioration, the number of times of execution of the removal operation is determined in which the intermediate transfer belt 57 is rotated in the reverse direction and then rotated in the forward direction, and the motor 60 is controlled so that the removal operation is executed the number of times of execution determined. For this reason, even when the degree of deterioration of the intermediate transfer belt 57 or the cleaning blade 58 is large, a foreign matter bitten between the intermediate transfer belt 57 and the cleaning blade 58 can be efficiently removed. Furthermore, when the degree of deterioration of the intermediate transfer belt 57 or the cleaning blade 58 is small, it is prevented that rolling up of the cleaning blade 58 occurs due to friction between the cleaning blade 58 and the intermediate transfer belt 57 in the removal operation. As a result, the cleaning performance by the cleaning blade 58 can be improved.

Preferably, the degree of deterioration of the intermediate transfer belt 57 or the cleaning blade 58 is evaluated on the basis of the surface roughness of the intermediate transfer belt 57, the degree of wear of the cleaning blade 58, or the distortion of the cleaning blade 58. For this reason, the degree of deterioration of the intermediate transfer belt 57 or the cleaning blade 58 can be easily evaluated.

Preferably, the degree of deterioration of the intermediate transfer belt 57 or the cleaning blade 58 is evaluated on the basis of the total amount of rotation of the intermediate transfer belt 57. For this reason, the degree of deterioration of the intermediate transfer belt 57 or the cleaning blade 58 can be easily evaluated.

Preferably, the MFP 100 further includes the photoreceptor drums 53Y, 53M, 53C, and 53K or the developing rollers 55Y, 55M, 55C, 55K that rotate simultaneously with the intermediate transfer belt 57 by the rotational force of the motor 60. In the removal operation, the intermediate transfer belt 57 is rotated in the reverse direction with a limited amount of rotation so that the photoreceptor drums 53Y, 53M, 53C, and 53K or the developing rollers 55Y, 55M, 55C, and 55K do not rotate in the reverse direction. For this reason, the intermediate transfer belt 57 and the photoreceptor drums 53Y, 53M, 53C, and 53K or the developing roller 55Y, 55M, 55C, and 55K are driven by the common motor 60, so that the size of the MFP 100 can be re reduced, and the cost of the MFP 100 can be reduced. Furthermore, since the photoreceptor drums 53Y, 53M, 53C, and 53K or the developing rollers 55Y, 55M, 55C, and 55K are prevented from rotating in the reverse direction when the intermediate transfer belt 57 is rotated in the reverse direction, it is possible to prevent problems caused by the reverse rotation of the photoreceptor drums 53Y, 53M, 53C, and 53K or the developing rollers 55Y, 55M, 55C, and 55K.

Preferably, in the removal operation, the motor 60 is driven so that the amount of rotation of the intermediate transfer belt 57 during the forward rotation is larger than the amount of rotation of the intermediate transfer belt 57 during the reverse rotation. For this reason, the foreign matter extracted from between the intermediate transfer belt 57 and the cleaning blade 58 due to the reverse rotation of the intermediate transfer belt 57 can be reliably removed by the forward rotation of the intermediate transfer belt 57.

Preferably, on the basis of the job including images of one or more pages, the toner image corresponding to the page for each page is carried on the intermediate transfer belt 57, and the toner image in response to the job is carried on the intermediate transfer belt 57, and then, the motor 60 is controlled so that the removal operation is executed. For this reason, the foreign matter bitten between the intermediate transfer belt 57 and the cleaning blade 58 is removed while the toner image in response to the job is carried on the intermediate transfer belt 57. Thus, h is possible to prevent degradation of image quality in the next job. Furthermore, image formation is not hindered by the removal operation. As a result, it is possible to prevent a decrease in productivity.

Preferably, when the next job is accepted while the motor 60 is controlled so that the removal operation is executed, the execution of the forward rotation of the intermediate transfer belt 57 in the final removal operation is omitted. Even when the execution of the forward rotation of the intermediate transfer belt 57 in the final removal operation is omitted, a foreign matter extracted from between the intermediate transfer belt 57 and the cleaning blade 58 due to the reverse rotation of the intermediate transfer belt 57 in the final removal operation is removed by the first forward rotation of the intermediate transfer belt 57 during image formation corresponding to the next job. For this reason, a removal operation time is shortened while cleaning performance by the cleaning blade 58 is maintained, whereby image formation corresponding to the next job can be performed at high speed.

Preferably, the number of times of execution of the removal operation is determined on the basis of the type of the recording medium on which the toner image in response to the job is transferred. For this reason, the number of times of execution of the removal operation can be determined more appropriately.

Preferably, the number of times of execution of the removal operation is determined on the basis of the number of sheets of the recording medium on which the toner image in response to the job is transferred. For this reason, the number of times of execution of the removal operation can be determined more appropriately.

Preferably, the number of times of execution of the removal operation is determined on the basis of the supply history in which the conveyer conveys the recording medium. For this reason, the number of times of execution of the removal operation can be determined more appropriately.

Preferably, when the selection of the number of times of execution of the removal operation is accepted, the selected number of times of execution is determined as the number of times of execution of the removal operation. For this reason, the removal operation can be executed the number of times desired by the user.

Supplementary Notes

Preferably, the image forming apparatus further includes:

a first transmission member that is provided between the driver and the image carrier, and transmits rotational force of the driver to the image carrier;

a second transmission member that is provided between the driver and the simultaneous drive member and transmits the rotational force of the driver to the simultaneous drive member, in which a backlash of the first transmission member is smaller than a backlash of the second transmission member.

Preferably; the image forming apparatus further includes:

a photoreceptor on winch an electrostatic latent image is formed by exposure after charging;

a developing unit that develops the electrostatic latent image formed on the photoreceptor with toner; and a transfer unit that transfers a toner image formed on the photoreceptor to the image carrier by developing the electrostatic latent image with toner by the developing unit, in which the simultaneous drive member is at least one of the photoreceptor or the developing unit.

Preferably, the removal operation executor controls the driver so that the amount of rotation of the driver during the reverse rotation is equal to or greater than the backlash of the first transmission member and less than the backlash of the second transmission member.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

an image carrier that carries a toner image including toner;

a driver that rotates the image carrier;

a toner remover that comes in contact with the image carrier and removes toner remaining on the image carrier while the image carrier is rotated in a forward direction by the driver; and a hardware processor that evaluates a degree of deterioration of the image carrier or the toner remover, determines a number of times of execution of removal operation in which the image carrier is rotated in a reverse direction and then rotated in the forward direction, on the basis of the degree of deterioration, and controls the driver to cause the removal operation to be executed the number of times of execution.

2. The image forming apparatus according to claim 1, wherein the hardware processor evaluates the degree of deterioration of the image carrier or the toner remover on the basis of a surface roughness of the image carrier, a degree of wear of the toner remover, or a distortion of the toner remover.

3. The image forming apparatus according to claim 1, wherein the hardware processor evaluates the degree of deterioration of the image carrier or the toner remover on the basis of a total amount of rotation of the image carrier.

4. The image forming apparatus according to claim 1, thither comprising a simultaneous drive member that rotates simultaneously with the image carrier by rotational force of the driver, wherein the hardware processor rotates the image carrier in the reverse direction with a limited amount of rotation not to cause the simultaneous drive member to rotate in the reverse direction in the removal operation.

5. The image forming apparatus according to claim 1, wherein the hardware processor drives the driver to cause an amount of rotation of the image carrier during the forward rotation to be larger than an amount of rotation of the image carrier during the reverse rotation, in the removal operation.

6. The image forming apparatus according to claim 1, wherein the hardware processor causes the image carrier to carry a toner image corresponding to a page for each page on the basis of a job including images of one or more pages, and controls the driver to cause the removal operation to be executed after a toner image in response to the job is carried on the image carrier by the hardware processor.

7. The image forming apparatus according to claim 6, wherein when a next job is accepted by the hardware processor while the hardware processor controls the driver to cause the removal operation to be executed, execution of forward rotation of the image carrier in the final removal operation is omitted.

8. The image forming apparatus according to claim 6, wherein the hardware processor determines the number of times of execution of the removal operation on the basis of a type of a recording medium on which the toner image in response to the job is transferred.

9. The image forming apparatus according to claim 6, wherein the hardware processor determines the number of times of execution of the removal operation on the basis of a number of sheets of the recording medium on which the toner image in response to the job is transferred.

10. The image forming apparatus according to claim 6, further comprising a conveyer that conveys a recording medium on which a toner image is to be transferred, wherein the hardware processor determines the number of times of execution of the removal operation on the basis of a supply history in which the conveyer has conveyed the recording medium.

11. The image forming apparatus according to claim 1, wherein the hardware processor determines a selected number of times of execution as the number of times of execution of the removal operation when selection of the number of times of execution of the removal operation is accepted.

12. An image forming method comprising:

carrying a toner image including toner by an image carrier;

rotating the image carrier by a driver;

removing toner remaining on the image carrier by a toner remover that comes in contact with the image carrier while the image carrier is rotated in a forward direction by the driver;

evaluating a degree of deterioration of the image carrier or the toner remover;

determining a number of times of execution of removal operation in which the image carrier is rotated in a reverse direction and then rotated in the forward direction, on the basis of the degree of deterioration; and executing, by the driver, the removal operation the number of times of execution determined.

13. A non-transitory recording medium storing a computer readable image forming program executed by a computer that controls an image forming apparatus, the image forming program causing the computer to execute:

carrying a toner image including toner by an image carrier;

rotating the image carrier by a driver;

removing toner remaining on the image carrier by a toner remover that comes in contact with the image carrier while the image carrier is rotated in a forward direction by the driver;

evaluating a degree of deterioration of the image carrier or the toner remover;

determining a number of times of execution of removal operation in which the image carrier is rotated in a reverse direction and then rotated in the forward direction, on the basis of the degree of deterioration; and executing, by the driver, the removal operation the number of times of execution determined.

* * * * *